US009586085B2

(12) United States Patent
Arnold et al.

(10) Patent No.: US 9,586,085 B2
(45) Date of Patent: Mar. 7, 2017

(54) EXERCISE APPARATUS WITH NON-UNIFORM FOOT PAD TRANSVERSE SPACING

(71) Applicant: Precor Incorporated, Woodinville, WA (US)

(72) Inventors: Peter J. Arnold, Snohomish, WA (US); James S. Birrell, Seattle, WA (US); Jonathan M. Stewart, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 0 days.

(21) Appl. No.: 14/271,951

(22) Filed: Jun. 4, 2014

(65) Prior Publication Data

US 2015/0352402 A1 Dec. 10, 2015

(51) Int. Cl.
*A63B 22/00* (2006.01)
*A63B 23/035* (2006.01)
(Continued)

(52) U.S. Cl.
CPC ..... *A63B 22/0007* (2013.01); *A63B 21/225* (2013.01); *A63B 22/0023* (2013.01);
(Continued)

(58) Field of Classification Search
CPC ..... A63B 21/00003; A63B 21/00007; A63B 21/00018; A63B 21/00021; A63B 21/00025; A63B 21/00029; A63B 21/00032; A63B 21/00058; A63B 21/00069; A63B 21/00072; A63B 21/00076; A63B 21/00094; A63B 21/00098; A63B 21/00101; A63B 21/00109; A63B 21/0012; A63B 21/00123; A63B 21/00127; A63B 21/00192; A63B 21/005; A63B 21/0051; A63B 21/0052; A63B 21/0056; A63B 21/0057; A63B 21/0058; A63B 21/012; A63B 21/0125; A63B 21/015; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/08;
(Continued)

(56) References Cited

U.S. PATENT DOCUMENTS 4,781,372 A 11/1988 McCormack
4,915,373 A 4/1990 Walker
(Continued)

*Primary Examiner* — Stephen Crow
*Assistant Examiner* — Gary D Urbiel Goldner
(74) *Attorney, Agent, or Firm* — Terence P. O'Brien; Todd A. Rathe

(57) ABSTRACT

A method and apparatus guide inclined movement of a left foot pad in a fore-aft direction on a first side of a longitudinal centerline of an exercise apparatus and inclined movement of a right foot pad in the fore-aft direction on a second side of the longitudinal centerline of the exercise apparatus such that the right foot pad and the left foot pad are transversely spaced from the longitudinal centerline by a first distance when proximate to a front of the exercise apparatus and are transversely spaced from the longitudinal centerline by a second distance greater than the first distance when proximate to a rear of the exercise apparatus.

16 Claims, 14 Drawing Sheets

(51) Int. Cl.

| | |
|---|---|
| ***A63B 21/22*** | (2006.01) |
| ***A63B 22/06*** | (2006.01) |
| ***A63B 22/20*** | (2006.01) |
| *A63B 21/012* | (2006.01) |

(52) U.S. Cl.

CPC ..... *A63B 22/0664* (2013.01); *A63B 22/203* (2013.01); *A63B 22/208* (2013.01); *A63B 23/03591* (2013.01); *A63B 21/012* (2013.01); *A63B 22/001* (2013.01); *A63B 22/0002* (2013.01); *A63B 2022/0028* (2013.01); *A63B 2022/067* (2013.01); *A63B 2022/206* (2013.01)

(58) Field of Classification Search

CPC ..... A63B 21/1465; A63B 21/1469; A63B 21/1476; A63B 21/1488; A63B 21/1492; A63B 21/1496; A63B 21/15; A63B 21/151; A63B 21/154; A63B 21/155; A63B 21/156; A63B 21/157; A63B 21/159; A63B 2021/0059; A63B 22/0002; A63B 22/0007; A63B 22/001; A63B 22/0015; A63B 22/0046; A63B 22/06; A63B 22/0694; A63B 22/08; A63B 22/20; A63B 22/201; A63B 22/203; A63B 22/205; A63B 2022/0017; A63B 2022/0025; A63B 2022/0028; A63B 2022/0043; A63B 2022/0617; A63B 2022/0641; A63B 2022/067; A63B 2022/206; A63B 23/035; A63B 23/03516; A63B 23/03575; A63B 23/03591; A63B 23/04; A63B 23/0405; A63B 23/0417; A63B 23/0423; A63B 23/0482; A63B 23/0494; A63B 23/12; A63B 23/1209; A63B 23/1245; A63B 23/1263; A63B 23/1281; A63B 69/0022; A63B 69/0028; A63B 69/0031; A63B 69/16; A63B 69/182; A63B 2069/0033; A63B 2208/02; A63B 2208/0204; A63B 2244/18; A63B 2244/19

See application file for complete search history.

(56) References Cited

U.S. PATENT DOCUMENTS

| | | | | |
|---|---|---|---|---|
| 4,993,704 | A | 2/1991 | Luczynski | |
| 5,242,343 | A | 9/1993 | Miller | |
| 5,277,681 | A * | 1/1994 | Holt | A61H 1/02 482/112 |
| 5,383,829 | A | 1/1995 | Miller | |
| 5,685,804 | A | 11/1997 | Whan-Tong et al. | |
| 5,911,650 | A | 6/1999 | Cox | |
| 6,123,650 | A | 9/2000 | Birrell | |
| 6,146,313 | A | 11/2000 | Whan-Tong et al. | |
| 6,165,107 | A | 12/2000 | Birrell | |
| 6,234,935 | B1 * | 5/2001 | Chu | A63B 21/018 482/51 |
| 6,238,321 | B1 | 5/2001 | Arnold et al. | |
| 6,277,055 | B1 | 8/2001 | Birrell et al. | |
| 6,482,130 | B1 | 11/2002 | Pasero et al. | |
| 6,749,540 | B1 | 6/2004 | Pasero et al. | |
| 6,752,744 | B2 | 6/2004 | Arnold et al. | |
| 6,786,850 | B2 | 9/2004 | Nizamuddin | |
| 6,939,271 | B1 | 9/2005 | Whan-Tong et al. | |
| 7,014,595 | B2 | 3/2006 | Bruno | |
| 7,115,073 | B2 | 10/2006 | Nizamuddin | |
| 7,402,126 | B2 | 7/2008 | Chang | |
| 7,556,592 | B2 | 7/2009 | Nizam | |
| 7,682,293 | B2 * | 3/2010 | Eschenbach | A63B 21/015 482/51 |
| 7,691,034 | B2 | 4/2010 | May et al. | |
| 7,704,192 | B2 | 4/2010 | Dyer et al. | |
| 7,731,634 | B2 | 6/2010 | Stewart et al. | |
| 7,731,635 | B2 | 6/2010 | Dyer | |
| 7,749,139 | B2 * | 7/2010 | Wang | A63B 22/001 482/57 |
| 7,758,472 | B2 | 7/2010 | Stewart | |
| 7,780,577 | B2 | 8/2010 | Arnold | |
| 7,959,544 | B2 | 6/2011 | Palmer | |
| 7,981,015 | B2 * | 7/2011 | Reed | A63B 21/0058 482/131 |
| 8,043,199 | B1 * | 10/2011 | Barker | A63B 22/0023 482/132 |
| 8,419,598 | B2 | 4/2013 | Dyer et al. | |
| 8,556,779 | B2 | 10/2013 | Grind | |
| 8,740,754 | B2 | 6/2014 | Miller | |
| 2004/0097335 | A1 * | 5/2004 | Chu | A63B 22/001 482/51 |
| 2005/0079956 | A1 * | 4/2005 | Bruno | A63B 22/203 482/51 |
| 2006/0046902 | A1 | 3/2006 | Chang | |
| 2008/0116655 | A1 * | 5/2008 | Pate | B62M 1/26 280/221 |
| 2009/0105050 | A1 | 4/2009 | Mayo | |
| 2009/0203501 | A1 * | 8/2009 | Rodgers, Jr. | A63B 22/001 482/52 |
| 2010/0093497 | A1 | 4/2010 | Kuo | |
| 2010/0151999 | A1 | 6/2010 | Kuo | |
| 2010/0167883 | A1 * | 7/2010 | Grind | A63B 22/001 482/71 |
| 2012/0004077 | A1 | 1/2012 | Chu | |
| 2014/0194253 | A1 * | 7/2014 | Huang | A63B 22/001 482/52 |
| 2014/0194254 | A1 * | 7/2014 | Huang | A63B 22/04 482/52 |

* cited by examiner

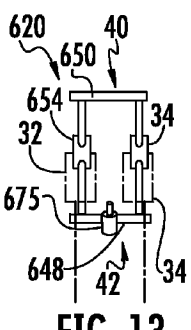
FIG. 13
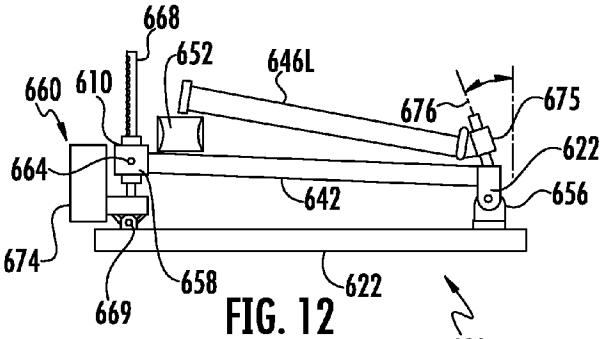
FIG. 12
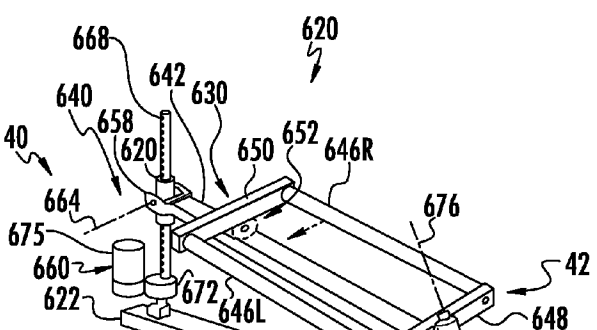
FIG. 11
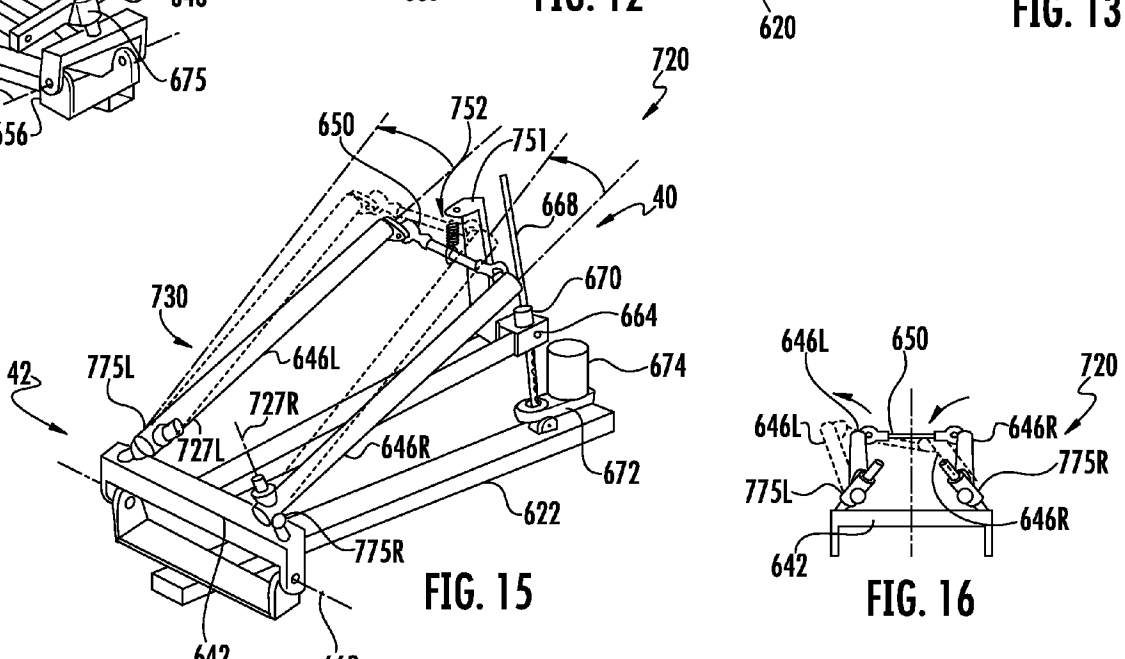
FIG. 15
FIG. 16
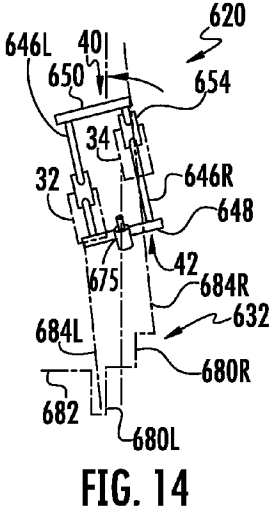
FIG. 14

EXERCISE APPARATUS WITH NON-UNIFORM FOOT PAD TRANSVERSE SPACING

BACKGROUND

Many exercise apparatus utilize footpads allowing a person exercising to stride against a source of resistance. Examples of such exercise apparatuses include, but are not limited to, elliptical and adaptive motion exercise machines. The guided movement of the footpads may not be along a natural or ergonomic path.

BRIEF DESCRIPTION OF THE DRAWINGS

FIG. 11 is a perspective view of a portion of another example exercise apparatus.

FIG. 12 is a side view of the exercise apparatus of FIG. 11.

FIG. 13 is a top view of the exercise apparatus of FIG. 11 further illustrating footpads supported by rollers in side-by-side positions.

FIG. 14 is a top view of the exercise apparatus of FIG. 11 further illustrating the footpads supported by rollers in front and rear positions to pivot tracks of the exercise apparatus.

FIG. 15 is a top perspective view of another example exercise apparatus illustrating different track positions.

FIG. 16 is a rear view of the exercise apparatus of FIG. 15 illustrating the two different track positions.

DETAILED DESCRIPTION OF THE EXAMPLE EMBODIMENTS

Figure 1:
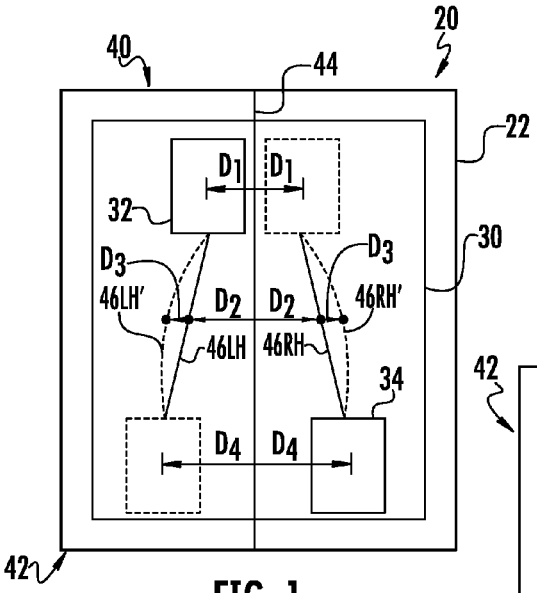
FIG. 1 is a top view schematically illustrating an example exercise apparatus.
Figure 2:
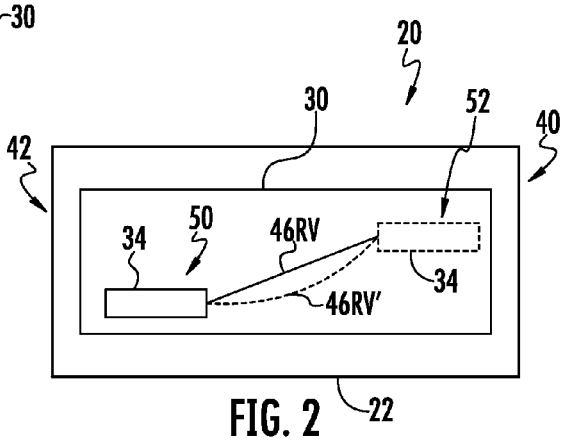
FIG. 2 is a side view schematically illustrating the exercise apparatus of claim 1.

FIG. 1 is a top view schematically illustrating an example exercise apparatus 20. FIG. 2 is a side view schematically illustrating the example exercise apparatus 20. As will be described hereafter, exercise apparatus 20 guides and directs movement of footpads along more natural and more ergonomic paths during striding motion by a person exercising. Exercise apparatus 20 comprises frame 22, motion guide 30, left foot pad 32 and right foot pad 34. Frame 22 comprises a base, foundation, frame or other structure serving as a platform for the remaining components of exercise apparatus 20. Exercise apparatus 20 has a front end 40 in which a person exercising faces while exercising, a rear end 42 and a fore-aft extending longitudinal centerline 44 which bisects exercise apparatus 20 into a left side and a right side.

Motion guide 30 comprises one or more structures which guide reciprocating and alternating movement of footpads 32, 34 during striding by the person exercising. Left foot pad 32 comprises a platform, pedal or foot rest upon which a person exercising places his or her left foot while striding. Left foot pad 32 is located on the left side of centerline 44. Right foot pad 34 comprise a platform, pedal or foot rest upon which a person exercising places his or her right foot while striding. Right foot pad 32 is located on the right side of centerline 44.

Motion guide 30 guides the movement of footpads 32, 34 such that when footpad 32 is moving towards front end 40, footpad 34 is moving towards rear end 42, and vice versa. Motion guide 30 guides movement of footpad 32 such that footpad 32 is closer to longitudinal centerline 44 as compared to when footpad 32 is passing (in either direction) footpad 34. In the example illustrated, motion guide 30 further guides movement of footpad 32 such that when footpad 32 is proximate to front end 40, footpad 32 is transversely spaced from longitudinal centerline 44 by transverse distance D1 and when footpad 32 is passing footpad 34, foot pad 32 is transversely spaced from longitudinal centerline 44 by transverse distance D2 (for path or track 46RH) or distance D2+D3 (for path or track 46RH') which is greater than distance D1. Likewise, motion guide 30 guides movement of footpad 34 such that footpad 32 is closer to longitudinal centerline 44 as compared to when footpad 34 is passing (in either direction) footpad 32. In the example illustrated, motion guide 30 further guides movement of footpad 34 such that when footpad 34 is proximate to front end 40, footpad 34 is transversely spaced from longitudinal centerline 44 by transverse distance D1 and when footpad 34 is passing footpad 32, foot pad 34 is transversely spaced from longitudinal centerline 44 by transverse distance D2 (for path or track 46RH) or distance D2+D3 (for path or track 46RH') which is greater than distance D1. As a result, motion guide 30 guides movement of footpads 32, 34 along paths that are more natural and ergonomic. During freeform running and walking, a person tends to place their steps closer to their center plane towards their center of gravity. Such positioning is especially noticeable at the foot plant or front of a stride. A person's forward plant step at the beginning of the stride is naturally more closely centered underneath the person's center of mass as compared to typical fitness products with parallel paths. Motion guide 30 facilitates the shape of the paths of footpads 32, 34 so as to conform to this natural plant step by locating footpads 32, 34 closer to centerline 44 proximate to the front end 40 of exercise apparatus 20.

In one implementation, motion guide 30 guides movement of footpads 32 and 34 such that footpads 32 and 34 are closer to centerline 44 both forward and rearward of the point in time that footpads 32, 34 pass one another. For example, motion guide 30 may guide movement of footpads 32 and 34 in arcuate paths similar to paths or tracks 46LH' and 46RH', wherein such arcs are spaced from centerline 44 by the greatest distance at a midpoint between front 44 and rear 42 and such that footpads 32, 34 are also transversely closer to the longitudinal centerline 44 proximate to rear end 42 as compared to when footpads 32, 34 are passing one another.

In one implementation, motion guide 30 comprises a pair of fixed inclined tracks along which footpads 32, 34 reciprocate in fore and aft directions in an alternating fashion, such as 180° out of phase with one another. As schematically indicated by solid lines 46LH, 46RH, in one implementation, motion guide 30 comprises tracks that are linear or straight in a horizontal dimension and that obliquely extend relative to centerline 44 so as to converge towards one another and towards centerline 44 as the tracks approach front end 40. As schematically indicated by broken lines 46LH' and 46RH', in another implementation, motion guide 30 alternatively comprises tracks that are curved in the horizontal dimension, wherein the tracks curve towards one another and towards centerline 44 as such tracks approach front end 40. As illustrated by solid line 46RV in FIG. 2, in one implementation, the tracks of FIG. 1 which are linear or curved in the horizontal dimension may also linearly extend in the vertical dimension from the lower position 50 proximate to rear end 42 to the upper position 52 proximate front end 40. In another implementation, as indicated by broken line 46RV', the tracks of FIG. 1 which are linear or curved in the horizontal dimension may also be curved in the vertical dimension, wherein the tracks curve upwardly from the lower position 50 proximate to rear end 42 two the upper position 52 proximate front end 40. In short, in one implementation, motion guide 30 may comprise longitudinally extending tracks, wherein the tracks either (1) linearly converge towards centerline 44 in the horizontal dimension (as in line 46RH) while linearly extending upward in the vertical dimension (as in line 46RV); (2) curve towards centerline 44 in the horizontal dimension (as in line 46RH) while linearly extending upward in the vertical dimension (as in line 46RV); (3) linearly converge towards centerline 44 in the horizontal dimension (as in line 46RH) while curving upwardly in the vertical dimension (as in line 46RV'); or (4) curve towards centerline 44 in the horizontal dimension (as in line 46RH') while curving upward in the vertical dimension (as in line 46RV').

In one implementation, the upward track from the lower position 50 to the upper position 52 changes as the ramp moves. In one implementation, exercise apparatus 20 additionally comprises an inclination adjuster which selectively raises and lowers the tracks of motion guide 30. For example, in one implementation, exercise apparatus 20 additionally comprises inclination adjuster 640 described hereafter with respect to FIGS. 11 and 12. In one implementation, the adjustment of the inclination of the tracks of motion guide 30 occurs in response to input or selections made by the person using the exercise device. In another implementation, exercise apparatus 20 automatically adjusts the inclination of the tracks of motion guide 30 based upon the positioning of footpad 32, 34 along such tracks. For example, in one implementation, a controller outputs control signals which are transmitted to an actuator to automatically adjust the inclination of the tracks of motion guide 30 based upon the stage of a workout program or routine. In another implementation, a controller additionally or alternatively utilizes a sensed positioning of a crank assembly operably coupled to footpads 32, 34 or the positioning of swing arms operably coupled footpads 32, 34 to determine the positioning of footpad 32, 34 along their respective tracks. Based upon such a determination, the controller may generate control signals which are transmitted to an actuator to automatically adjust the inclination of the tracks of motion adjuster 30.

In another implementation, as will be described hereafter, motion guide 30 comprises a pair of parallel inclined tracks. In one implementation, the pair of parallel inclined tracks pivot about an axis at the rear of the tracks extends upwardly and forwardly such that the front end of the tracks pivot side to side to alternatively position the left inclined track and the right inclined track closer to centerline 44. In yet another implementation, as will be described hereafter, motion guide 30 comprises a pair of parallel inclined tracks, wherein front end of left and right tracks are suspended by a centered spring and wherein rear ends of the left inclined track and the right inclined track each pivot about transversely extending inclined axes such that the front end of the left inclined track and the right inclined track pivot side to side to alternately position the left inclined track and the right inclined track closer to centerline 44. In yet another implementation, as will be described hereafter, motion guide 30 comprises a pair of parallel tracks, wherein both the rear end and the front end of the parallel tracks pivot about an inclined fore-aft extending axis to alternately position a front portion of the left inclined track and the right inclined track closer to the centerline 44 as compared to the rear portion of the left inclined track and the right inclined track.

Figure 3:
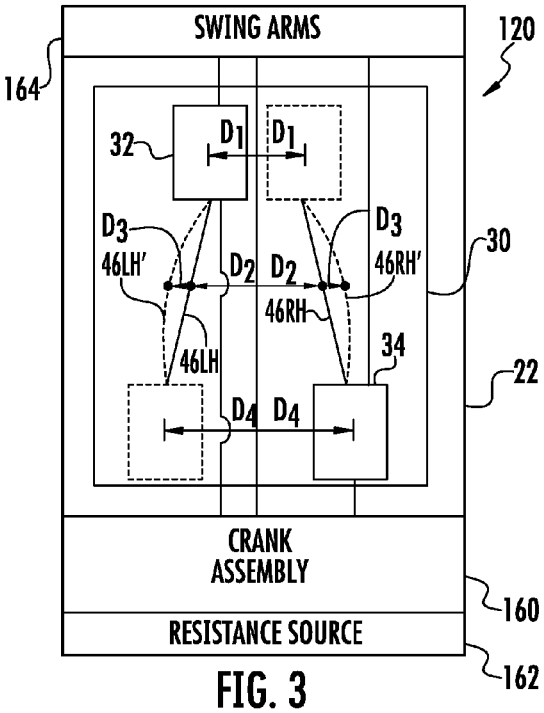
FIG. 3 is a top view schematically illustrating another example exercise apparatus

FIG. 3 schematically illustrates exercise apparatus 120, another example implementation of exercise apparatus 20. Exercise apparatus 120 is similar to exercise apparatus 20 except that exercise apparatus 120 is specifically illustrated as additionally comprising crank assembly 160, resistance source 162 and swing arms 164. Crank assembly 160 comprises a crank operably coupled to left footpad 32 and right footpad 34. Crank assembly 160 links motion of footpads 32 and 34 such that the reciprocal movement of footpads 32 and 34 is approximately 180° out of phase. Crank assembly 160 further applies a first extent of resistance against motion of footpads 32, 34. In one implementation, crank assembly 160 comprises a rotating wheel, wherein footpads 32, 34 are eccentrically coupled to the rotating wheel by foot links. In another implementation a crank assembly 160 comprises arms connected to the rotating wheel at one end and connected to foot links at another end, where the foot links are connected to footpads 32 and 34. In one implementation, crank assembly 160 is configured such that footpads 32, 34 move in an inclined elliptical path.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Resistance source 162 comprises a supplemental source of resistance to resist reciprocating movement of footpads 32 and 34. In one implementation, resistance source 162 is operably coupled to footpads 32, 34 via crank assembly 160. In one implementation, resistance source 162 comprises a friction resistance source in which rotation of two members relative to another is frictionally resisted. In yet another implementation, resistance source 162 comprises an eddy current brake. In one implementation, supplemental resistance provided by resistance source 162 against reciprocating movement of footpads 32, 34 is adjustable by an operator. In some implementations, resistance source 162 may be omitted.

Swing arms 164 comprise left and right arms operably coupled to footpads 32, 34 such that as footpads 32 and 34 reciprocate back and forth, or forwardly and rearwardly. Swing arms 164 also swing, or pivot back and forth, providing exercise to the upper body of a person using exercise apparatus 120. In one implementation, exercise apparatus 120 comprises a source of resistance that is applied to the swinging motion of swing arms 164. In other implementations, swing arms 164 may be omitted, such as in implementations where exercise apparatus 120 alternatively comprises stationary arms or bars.

Figure 4:
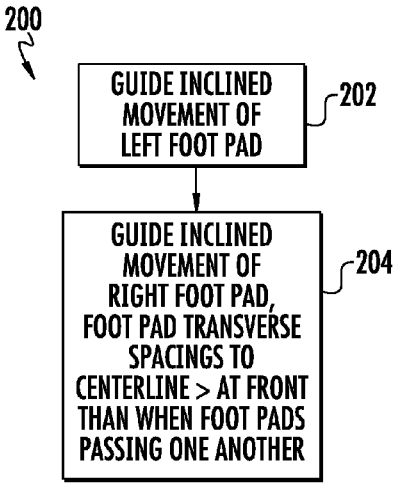
FIG. 4 is a flow diagram of an example method that may be carried out by the exercise apparatus of FIG. 1 or FIG. 2

FIG. 4 is a flow diagram of an example method 200 that may be carried out by the exercise apparatus 20 or exercise apparatus 120. As indicated by block 202, motion guide 30 guides inclined movement of left footpad 32. As indicated by block 204, motion guide 30 also guides inclined movement of right footpad 34. As further indicated by block 202, movement of the left footpad 32 and movement of the right footpad 34 is guided such that the left footpad 32 and the right footpad 34 are transversely spaced from the longitudinal centerline 44 by a first distance D1 proximate a front end 40 of exercise apparatus 20, 120 and are transversely spaced from the longitudinal centerline 44 by a second distance D2 greater than the first distance D1 when pedals are passing one another, providing clearance for the passing of such footpads by one another while, at the same time, facilitating forward foot plants that are closer to the person's center of gravity and closer to a person's natural stride.

Figure 5:
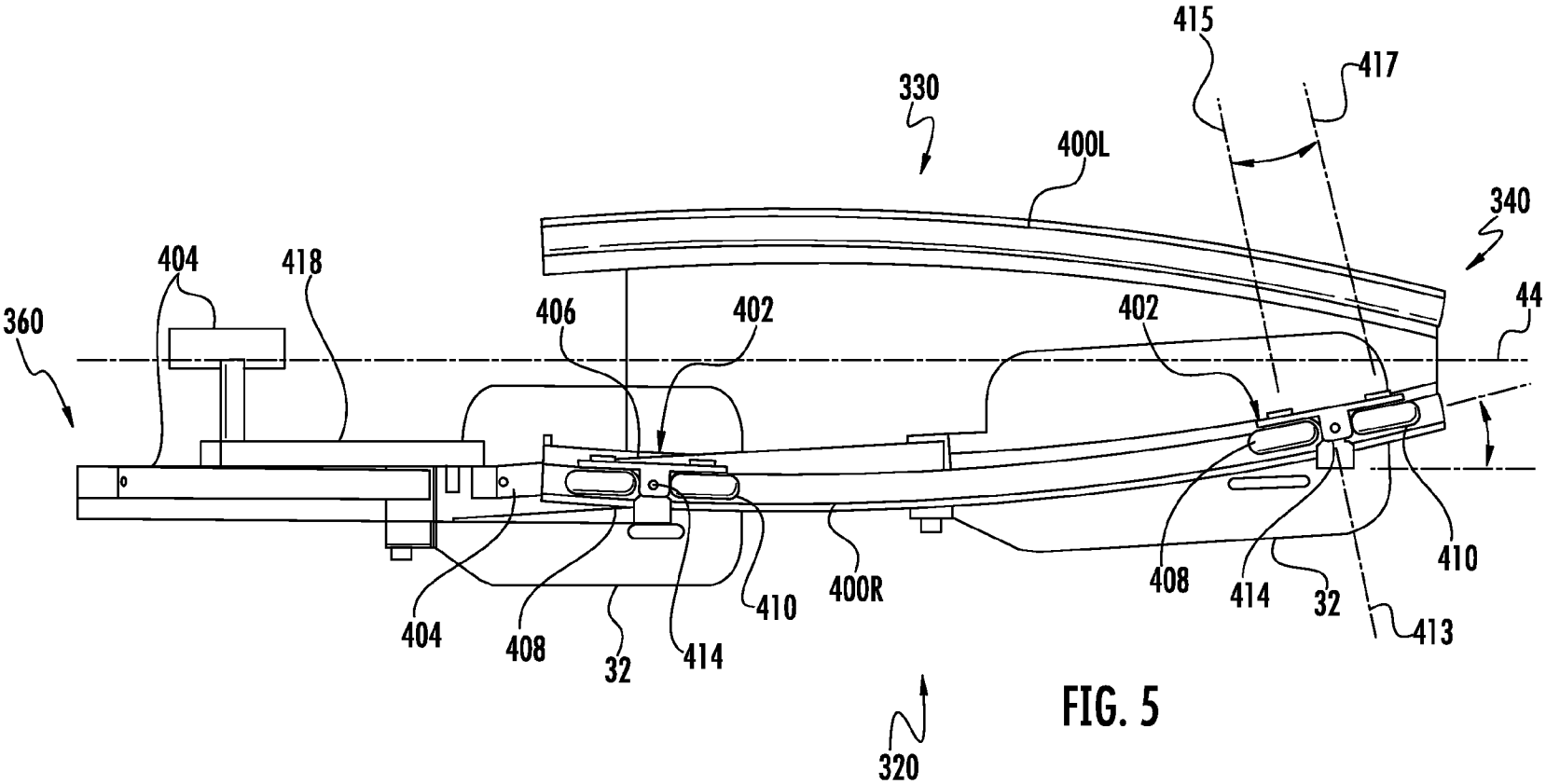
FIG. 5 is a top view of a portion of another example exercise apparatus illustrating two positions of an example trolley along a track.
Figure 6:
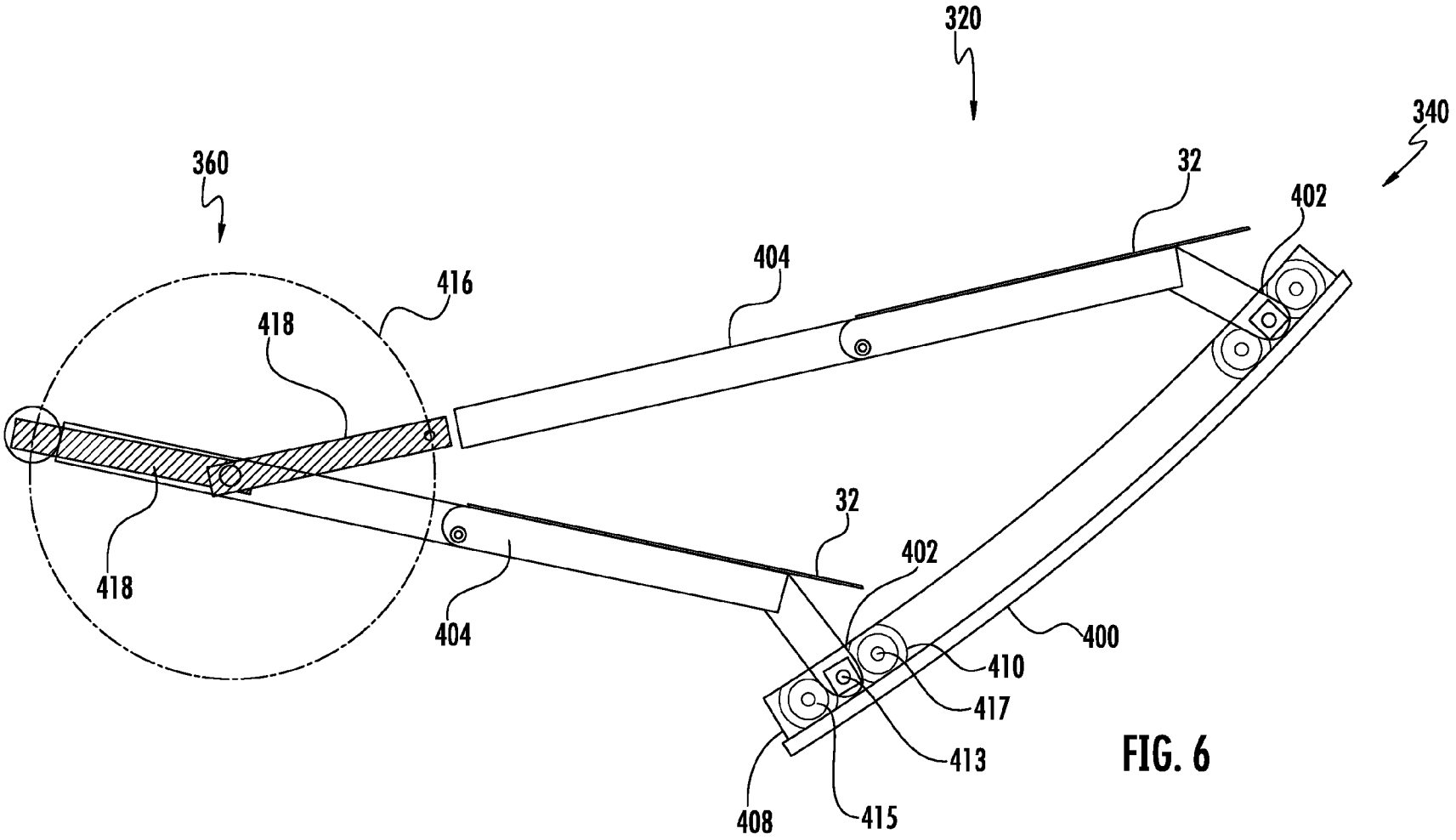
FIG. 6 is a side view of the exercise apparatus of FIG. 5 illustrating the two positions of the trolley along the track.

FIGS. 5 and 6 illustrate exercise apparatus 320, an example implementation of exercise apparatus 120. Exercise apparatus 320 is similar to exercise apparatus 120 in all respects except that exercise apparatus 320 is specifically illustrated as comprising an example motion guide 330 and crank assembly 360. Although not shown, exercise apparatus 320 additionally comprises swing arms 164 (shown in FIG. 3). FIG. 5 is a top view of exercise apparatus 320 with portions of the left side omitted for purposes of illustration. Those portions of the left side, which are omitted for purpose of illustration, mirror the illustrated portions of the right side of exercise apparatus 320. FIG. 6 is a side view of the right side portions illustrated in FIG. 5

As shown by FIGS. 5 and 6, motion guide 330 comprises right inclined track 400R, right trolley 402 and right foot link 404. As shown by FIGS. 5 and 6, track 400 is a compound curve, curving in two dimensions. As shown by FIG. 5, track 400 curves in a horizontal dimension. As shown by FIG. 6, track 400 curves in a vertical dimension. In the example illustrated, track 400 comprises a track having a J-shaped cross-section forming an upwardly facing channel or trough in which trolley 402 rides and is contained. In other implementations, depending upon the configuration of trolley 402, track 400 may alternatively comprise a U-shaped channel having a U-shaped cross-section with the channel having the same compound curve, wherein right trolley 402 rides within the channel. In another implementation, track 400 may comprise a cylindrical rod having the same compound curve, wherein the right trolley 402 rides on top of the rod.

Right trolley 402 movably supports right foot link 404 and footpad 32 along track 400. FIGS. 5 and 6 illustrate right trolley 402 at two extreme locations along track 400. In the example illustrated, right trolley 402 comprises a bracket 406 rotatably supporting a pair of wheels or rollers 408, 410. Bracket 406 comprises a two part bracket comprising: a first part rotatably supporting rollers 408, 410 and pivotable about a substantially horizontal axis 413 to accommodate the curvature of track 400 in the vertical dimension (as well as the constantly changing angle of the foot link from crank rotation); and a second portion carrying the first portion, wherein the second portion is rotationally coupled to foot link 404 for rotation about axis 414, a substantially vertical axis, facilitating angular adjustment of bracket 406 and rollers 408, 410 as trolley 402 travels along the curvature of track 400 in the horizontal dimension.

In the example illustrated, rollers 408, 410 rotate about non-parallel, oblique axes 415, 417 which intersect on a side of trolley 402 closest to centerline 44. The angle at which the axes 415, 417 of rollers 408, 410 are offset corresponds to or is based upon the curvature of track 400 in the horizontal dimension shown in FIG. 5. The angular offset of the axes 415, 417 of rollers 408, 410 facilitates enhanced tracking of trolley 402 along track 400. In one implementation, the axis about which rollers 408, 410 rotate are angularly offset between 1° and 5° and nominally about 2°. In the example illustrated, the axes about which rollers 408, 410 rotate are additionally inclined from horizontal such that the top side of each of rollers 408, 410 lean inward towards longitudinal centerline 44. In other implementations, the angular offset between the axes of rollers 408, 410 and/or the inclination of the axes about which rollers 408, 410 rotate may be omitted.

Right foot link 404 is pivotally coupled to a top side of trolley 402 and extends rearwardly to where right foot link 404 is pivotally connected to crank assembly 360. As best shown by FIG. 6, crank assembly 360 comprises flywheel 416 and right crank arm 418. Flywheel 416 rotates about a substantially horizontal axis. In one implementation, flywheel 416 is operably coupled to resistance source 162 (shown in FIG. 3). Crank arm 418 is fixed to and extends from flywheel 416. Crank arm 418 is pivotally connected to a rear end portion of foot link 404.

As noted above, the construction of the left side of exercise apparatus 320 substantially mirrors the construction of the above-described right side of exercise apparatus 320. As shown by 5, motion guide 330 additionally comprises a left inclined track 400L which comprise a compound curve curving in both a horizontal and a vertical dimension. Left inclined track 400L curves in the horizontal dimension inwardly towards longitudinal centerline 44 as track 400L extends towards front end 340 of exercise apparatus 320. Although not illustrated, motion guide 330 additionally comprises a trolley 402 which rides along track 400L in which is pivotally connected to a left foot link which is in turn connected to a crank arm carried by flywheel 416.

Figures 7, 8, 9, 10:
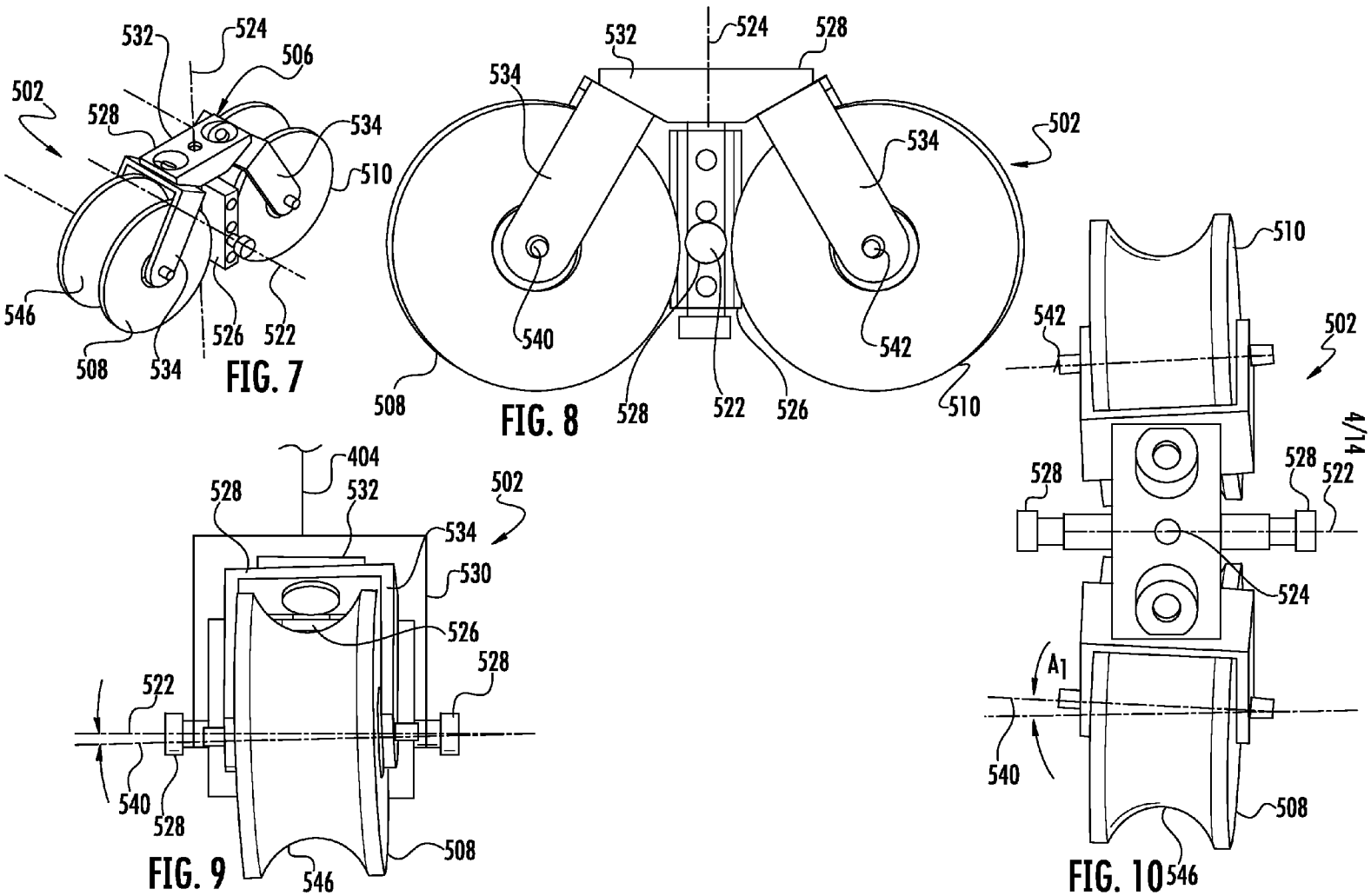
FIG. 7 is a top perspective view of an example trolley.
FIG. 8 is a side view of the trolley of FIG. 7.
FIG. 9 is an end view of the trolley of FIG. 7.
FIG. 10 is a top view of the trolley of FIG. 7.

FIGS. 7-10 illustrate trolley 502, an example of a trolley that may be utilized with a track having the compound curvature of track 400R, but wherein track 400 comprises a cylindrical rod upon which trolley 502 rides. Trolley 502 comprises bracket 506 and wheels or rollers 508, 510. Bracket 506 movably supports rollers 508, 510 relative to foot link 404 (shown in FIG. 6). Bracket 506 facilitates pivotal movement of rollers 508, 510 about axes 522, 524. In the example shown, bracket 506 comprises foot link mounting joint 526 and rollers support 528. Foot link mounting joint 526 comprises a member located between rollers 508, 510 configured to be pivotally mounted to foot link 404. As shown by FIG. 9, in the example illustrated, foot link mounting joint 526 comprises a pair of opposing posts 528 centered along axis 522. Posts 528 are pivotally coupled to a clevis 530 (schematically shown) of foot link 404. As a result, trolley 502 pivots about axis 522, a substantially horizontal axis, to accommodate the curvature of track 400 in the vertical dimension (the upwardly inclined curvature of track 400 as it approaches front end 40). In other implementations, other structures may be provided that facilitate pivotal movement of carriage 502 about axis 522.

Roller support 528 comprises a structure which rotatably supports each of rollers 508, 510. Roller support 528 is pivotably coupled to joint 526 for pivotal movement about axis 524. In one implementation, roller support 528 is pinned to joint 526 to facilitate relative pivotal movement between the support 528 and joint 526 about axis 524 which is substantially perpendicular axis 522. As a result, roller support 528 and rollers 508, 510 may pivot about axis 524 to accommodate the curvature of track 400 in the horizontal dimension. Although roller support 528 is illustrated as comprising a central portion 532 from which a pair of clevises 534 extend to pivotally support rollers 508, 510, in other implementations, other structures may be utilized to rotationally support rollers 508, 510 while pivoting about axis 524.

Rollers 508, 510 are each rotationally supported by wheel support 528. As shown by FIG. 10, roller 508 is rotationally supported about axis 540. Roller 510 is rotationally supported about axis 542. Axes 540 and 542 extend oblique relative to one another such that axes 540 and 542 ultimately converging cross one another in space on a side of rollers 510, 508 proximate to longitudinal centerline 44 (shown in FIG. 5). In one implementation, rollers 508, 510 rotate about oblique, non-parallel axes such that rollers 508, 510 are centered located along an arc corresponding to the curvature of track 400 in the horizontal dimension. As a result, rollers 508, 510 better track along the curvature of track 400. In one implementation, each of axes 540, 542 is offset by an angular extent A1 a between 1 degree and 5 degrees and nominally 2 degrees.

As shown by FIG. 9, axes 540 and 542 are each inclined from horizontal such that the top side of each of rollers 408, 410 leans inward towards longitudinal centerline 44 (shown in FIG. 5). As a result, tracking of rollers 508, 510 along the curvature of track 400 is enhanced. In other implementations, the angular offset between the axes 540, 542 of rollers 408, 410 and/or the inclination of the axes 540, 542 about which rollers 408, 410 rotate may be omitted. Although rollers 508, 510 are illustrated as comprising concave rolling surfaces 546 configured to receive the convex outer surface of a rod forming track 400, in other implementations in which track 400 comprises a channel in which rollers 508, 510 ride, rollers 508, 510 alternatively have convex or rounded outer surfaces or flat outer surfaces.

FIGS. 11-14 schematically illustrate exercise apparatus 620, another example implementation of exercise apparatus 20. As with exercise apparatus 20, exercise apparatus 120 and exercise apparatus 320, exercise apparatus 620 guides movement of footpads such that when a footpad is proximate to front end of the exercise apparatus, the footpad is transversely closer to longitudinal centerline of the exercise apparatus as compared to when the footpad is passing the opposite footpad of the exercise apparatus. As a result, footpads 32, 34 move along paths that are more natural and ergonomic. However, unlike exercise apparatus 320, exercise apparatus 620 utilizes pivotal movement of the tracks upon which the footpads are guided to provide or enhance the closer transverse spacing of the footpads at the front end of the exercise apparatus as compared to the rear end. As a result, exercise apparatus 620 may utilize pairs of tracks which are parallel to one another or which even outwardly diverge away from one another as such tracks approach the front end of the exercise apparatus. In some implementations, exercise apparatus 620 utilizes a pair of tracks that converge towards one another as such tracks approach the front end, in a curved or linear fashion as described above with respect to system 20, but wherein the pair tracks additionally pivot for enhanced transverse spacing control of footpads 32, 34.

In the specific example illustrated, exercise apparatus 620 comprises frame 622, motion guide 630, footpads 32, 34 (shown in FIGS. 13 and 14) and crank assembly 632 (shown in FIG. 14). Frame 622 comprises a base, substrate or platform for supporting the remaining components of exercise apparatus 620.

Motion guide 630 comprises inclination adjuster 640, substructure 642, tracks 646L, 646R (collectively referred to as tracks 646), rear cross connector 648, front cross connector 650, fulcrum 652 and rollers 654 (shown in FIGS. 13 and 14). Inclination adjuster 640 facilitates selective adjustment of the incline of tracks 646 and the incline of the path along which footpads 32, 34 (shown in FIGS. 13 and 14) move. In the example illustrated, inclination adjuster 640 comprises rear pivot mount 656, front pivot mount 658 and lifter 660. Rear pivot mount 656 comprises a structure which pivotally supports substructure 642 of motion guide 634 pivotal movement about a horizontal axis 662. Front pivot mount 658 comprises structure pivotally supporting substructure 652 at front end 40 for pivotal movement about a horizontal axis 664.

Lifter 660 comprising mechanism to selectively raise and lower substructure 642 at front end 40 such that substructure 642 pivots about axis 662. In the example illustrated, lifter 660 comprises a powered lifting mechanism which pivots about axis 669. In the example illustrated, lifter 660 comprises an externally threaded shaft 668, internally threaded nut 670, transmission 672 and lift motor 674. Internally threaded nut 670 is threaded upon externally threaded shaft 668. Internally threaded shaft 668 is pivotally coupled to frame 622, along with motor 660 and transmission 672, for pivotal movement about axis 669. Nut 670 pivotally supports substructure 642 about axis 664. Transmission 672 operably coupled shaft 668 to lift motor 674. In one implementation, transmission 672 comprises a belt and pulley arrangement. In another implementation, transmission 672 comprises a chain and sprocket arrangement or a gear train. Lift motor 674 comprises an electric motor, such as a stepper motor, configured to, in response to control signals from a control panel (not shown) of exercise apparatus 620, to supply torque so as to rotate shaft 668 so as to raise or lower substructure 642 at front end 42 pivot substructure 642 and tracks 646 about axis 662. In other implementations, inclination adjuster 640 may be omitted, wherein substructure 642 is fixed at a predetermined inclination, rising as substructure 642 approaches front end 40. In other implementations, lifter 660 may comprise a manual device to adjust a vertical height at which substructure 642 is supported at front end 40.

Substructure 642 supports the remaining portions of motion guide 630. Substructure 642 pivotally mounted to nut 670 at front end 40 and is pivotally mounted to pivot joint 656 at rear end 42. Tracks 646L, 646R are configured to guide movement of footpads 32, 34 in the fore and aft directions, respectively. In the example illustrated, tracks 646 extend parallel to one another and are linear in both the vertical and horizontal dimensions. As noted above, in other implementations, tracks 646 may alternatively diverge from one another as such tracks approach front end 40 or may converge towards one another as tracks 646 approach front end 40. In other implementations, tracks 646 may be curved in one or both of the horizontal dimension and the vertical dimension.

Rear cross connector 648 extends between and joins tracks 646 at rear end 42. Rear cross connector 648 comprises pivot joint 675 which pivotally couples rear cross connector 648 and tracks 646 to substructure 642 for pivotal movement about a forwardly inclined or forwardly angled axis 676. In the example illustrated, axis 676 is equidistantly spaced between the axes of tracks 646. Front cross connector 650 extends between and joins tracks 646 at front end 40. Front cross connector 650 rides upon fulcrum 652. Fulcrum 652 comprise a structure supported by substructure 642 upon which front cross connector 650 pivots about an inclined axis. In the example illustrated, fulcrum 652 comprises a resiliently compressible cylinder affixed to substructure 642 beneath connector 650, wherein connector 650 rolls and pivots across a top of the cylinder as a cylinder is resiliently compressed. In one implementation, the compressible cylinder forming fulcrum 652 is formed from a resiliently compressible foam. As a result, fulcrum 652 additionally provides cushioning. In other implementations, fulcrum 652 may have other shapes and may be formed from other materials.

Rollers 654 comprise one or more rollers rotationally supported and coupled to foot tracks 32 and 34. Rollers 654 roll along tracks 646. In the example illustrated in which tracks 646 comprise cylindrical rods, rollers 654 each include circular grooves which receive such cylindrical rods. In implementations in which tracks 646 comprise channels or grooves, rollers 654 may have convex, round or flat outer circumferential surfaces that ride within such channels.

Crank assembly 632 (schematically shown in FIG. 14) comprises crank arms 680L, 680R which are rotatably supported by frame 622 about axis 682. Crank arm 680L is connected to foot pad 32 by foot link 684L which is pivotally connected at its ends to crank arm 680L and foot link 32. Crank arm 680R is connected to foot pad 32 by foot link 684R which is pivotally connected at its ends to crank arm 680L and foot link 32. Crank arm assembly 632 links movement of footpads 32, 34 along tracks 646 such that as one of footpads 32, 34 is moving forward, the other of footpads 32, 34 is moving rearward. In one implementation, crank assembly 632 may further operably couple the movement of footpads 32, 34 to a source of resistance.

FIGS. 13 and 14 illustrate operation of exercise apparatus 620. FIG. 13 illustrates exercise apparatus 620 at a point in time in which footpads 32, 34 extend side-by-side along tracks 646. In such a state, the load placed upon tracks 646 is substantially equal, resulting in tracks 646 each being equidistantly transversely spaced from the longitudinal centerline of exercise apparatus 44 and equidistantly spaced from the axis connecting fulcrum 642 and axis 676.

FIG. 14 illustrates exercise apparatus 620 at a point time in which footpad 34 is forward or proximate to front end 40 while footpad 32 is proximate to rear end 42. As shown by FIG. 14, the forward positioning of footpad 34 results in a greater load being placed upon track 646R proximate to fulcrum 652 as compared to the load placed upon track 646L proximate to fulcrum 652. Because the load seeks the low point on the inclined angled axis, track 646R pivots inward, towards the centerline of exercise apparatus 620 and towards the inclined axis extending between fulcrum 652 and axis 676. In a similar fashion, when footpad 32 is forward relative to footpad 34, the forward positioning of footpad 32 results in a greater load being placed upon track 646L proximate to fulcrum 652 as compared to the load placed upon track 646R proximate to fulcrum 652. Because the load seeks the low point on the incline angled axis, track 646L pivots inward, towards the centerline of exercise apparatus 620 and towards the inclined axis extending between fulcrum 652 and axis 676. As a result, tracks 646 utilize gravity to automatically pivot in response to a user's stride such that footpads 32, 34 are closer to the longitudinal centerline of exercise apparatus 620 when proximate to front end 40 as compared to when footpads 32, 34 are proximate to the rear end 42, providing the person exercising with the more natural and ergonomic foot plant locations.

FIGS. 15 and 16 illustrate exercise apparatus 720, another example implementation of exercise apparatus 20. Exercise apparatus 720 is similar to exercise apparatus 620 except that exercise apparatus 720 comprises motion guide 730 in lieu of motion guide 630. As with exercise apparatus 620, exercise apparatus 720 comprises footpads 32, 34 and crank assembly 632 (shown described above with respect to exercise apparatus 620) connected to footpad 32, 34 by foot links 684.

Motion guide 730 is similar to motion guide 630 except that motion guide 730 comprises pivot joints 775L, 775R (collectively referred to as pivot joints 775), post 751 and spring 752 in place of rear cross connector 648, pivot joint 675 and fulcrum 652. As with motion guide 630, motion guide 730 comprises inclination adjuster 640, substructure 642, tracks 646L, 646R and front cross connector 650 (shown in the form of a connecting link). Pivot joints 775 pivotally connect tracks 646 to substructure 642 at rear 42 of exercise apparatus 720. Pivot joint 775L pivotally connects track 646L to a left side of substructure 642 at rear 42 while pivot joint 775R pivotally connects track 646R to the right side of substructure 642 at rear 42. Pivot joint 775 pivotally supports track 646 for pivotal rotation about transversely extending inclined axes 777L and 777R which are transversely inclined so as to intersect above and transversely between tracks 646.

Post 751 projects above substructure 642 at front end 40 of exercise apparatus of 720. Post 751 suspends spring 752. Spring 752 extends from post 751 and is connected to a midpoint of front cross connector 650. In the example illustrated, spring 752 comprises a tension spring. Spring 752 is similar to fulcrum 652 in that spring 752 facilitates pivoting of track 646 proximate front end 40 about the forwardly inclined axis. Absent a non-uniform load placed upon track 646 between front end 40 and rear end 42, spring 752 resultantly returns tracks 646 to a position in which tracks 646 are equidistantly spaced from a longitudinal centerline of exercise apparatus 720.

FIGS. 15 and 16 illustrate tracks 646 in solid lines when footpads 32, 34 are side-by-side as shown in FIG. 13. FIGS. 15 and 16 illustrate tracks 646 in broken lines when footpad 32, 34 are forwardly and rearwardly offset from one another such as in the state shown in FIG. 14 when footpad 34 is proximate to front end 40 while footpad 32 is proximate to rear 42. As shown by such broken lines, exercise apparatus 720 performs similar to exercise apparatus 620. The forward positioning of footpad 34 results in a greater load being placed upon track 646R proximate to spring 752 as compared to the load placed upon track 646L proximate to spring 752. Because the load (the weight of the person exercising being placed upon the forward footpad) seeks the low point on the incline angled axis, track 646R pivots inward about axis 777R, towards the centerline of exercise apparatus 620. In a similar fashion, when footpad 32 is forward relative to footpad 34, the forward positioning of footpad 32 results in a greater load being placed upon track 646L proximate to spring 752 as compared to the load placed upon track 646R proximate to spring 752. Because the load seeks the low point on the inclined angled axis, track 646L pivots inward, towards the centerline of exercise apparatus 620 about axis 777L. As a result, tracks 646 utilize gravity to automatically pivot in response to the position of footpads 32, 34 and the load being placed upon track 646 such that footpads 32, 34 are closer to the longitudinal centerline of exercise apparatus 720 when proximate to front end 40 as compared to when footpads 32, 34 are passing one another, providing the person exercising with the more natural and ergonomic foot plant locations.

FIGS. 17-20 illustrate exercise apparatus 820, another example implementation of exercise apparatus 20. Exercise apparatus to 820 is similar to exercise apparatus 620 except that exercise apparatus 820 comprises motion guide 830 in lieu of motion guide 630. As with exercise apparatus 620, exercise apparatus 820 comprises frame 622, footpads 32, 34 (shown FIG. 13) and crank assembly 632 connected to foot pad 32, 34 by foot links 684 (shown in FIG. 14). Motion guide 830 is similar to motion guide 630 except that motion guide 730 comprises pivot joint 875, post 851 and pendulum 852 in place of pivot joint 675 and fulcrum 652. As with motion guide 630, motion guide 730 comprises incline adjuster 640, substructure 642, tracks 646L, 646R, rear cross connector 648 and front cross connector 650. Pivot joint 875 pivotally connects rear cross connector 648 to substructure 642. Pivot joint 875 pivotally supports rear cross connector 648 about a forward inclined axis 876.

Figure 20:
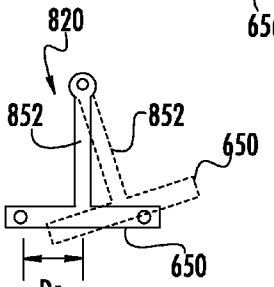
FIG. 20 is an end view of a portion of the exercise apparatus of FIG. 19 illustrating two alternative positions for a pendulum of a first length supporting the tracks.

Post 851 projects upwardly from substructure 642 at front 40 of exercise apparatus 820. Post 851 pivotally supports pendulum 852 which hangs from a top portion of post 851 and is connected to a central portion of front cross connector 650. Pendulum 852 is pivotally supported by post 851 about axis 876. As shown by FIG. 20, post 851 and pendulum 85 to cooperate to facilitate swinging of tracks 646 about axis 876.

Figure 18:
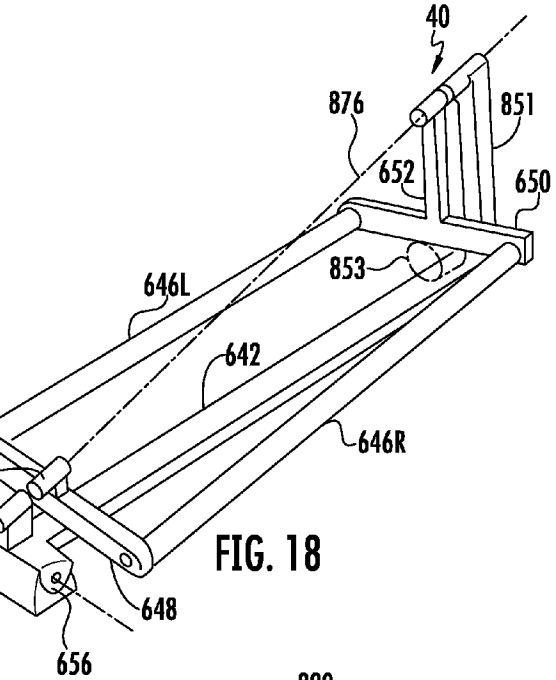
FIG. 18 is a perspective view of a portion of the exercise apparatus of FIG. 17 illustrating tracks in a neutral state.

As shown by FIG. 18, in one implementation, motion guide 830 additionally comprises cushion 853. Cushion 853 comprises a resiliently compressible structure captured between substructure 642 and an underside of front cross connector 650. Cushion 853 resultantly biases tracks 646 to a centered position in which each of track 646 is equidistantly spaced from axis 876. In the example illustrated, cushion 853 comprises a resiliently compressible cylinder affixed to substructure 642 beneath connector 650, wherein connector 650 rolls and pivots across a top of the cylinder as a cylinder is resiliently compressed. In one implementation, the compressible cylinder forming cushion 853 is formed from a resiliently compressible foam. In other implementations, cushion 853 may have other shapes, may be formed from other materials or may be omitted.

Figure 19:
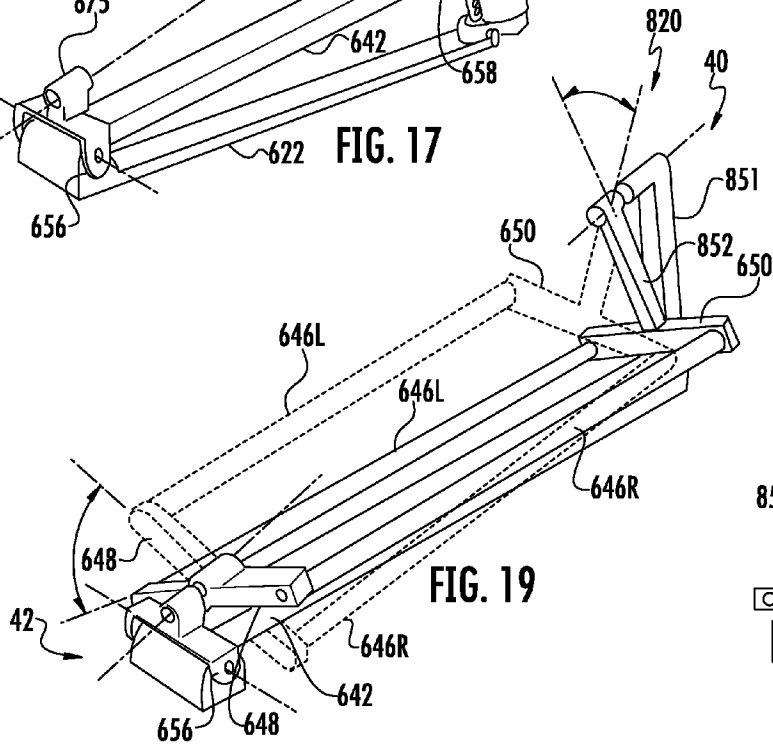
FIG. 19 is a perspective view of the exercise apparatus of FIG. 18 illustrating two different track positions.
Figure 17:
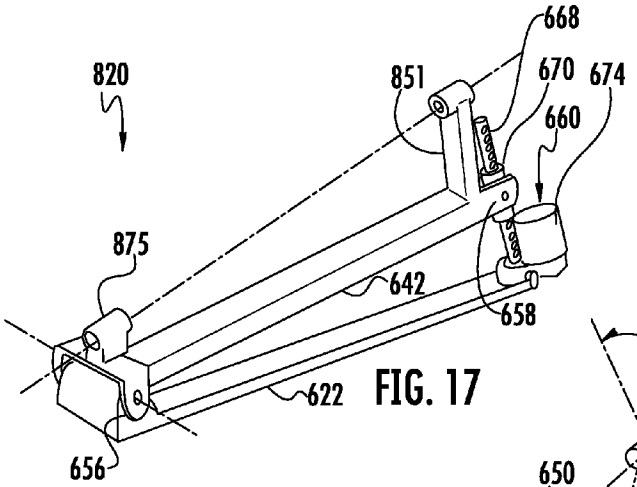
FIG. 17 is a perspective view of a portion of another example exercise apparatus.
Figure 22:
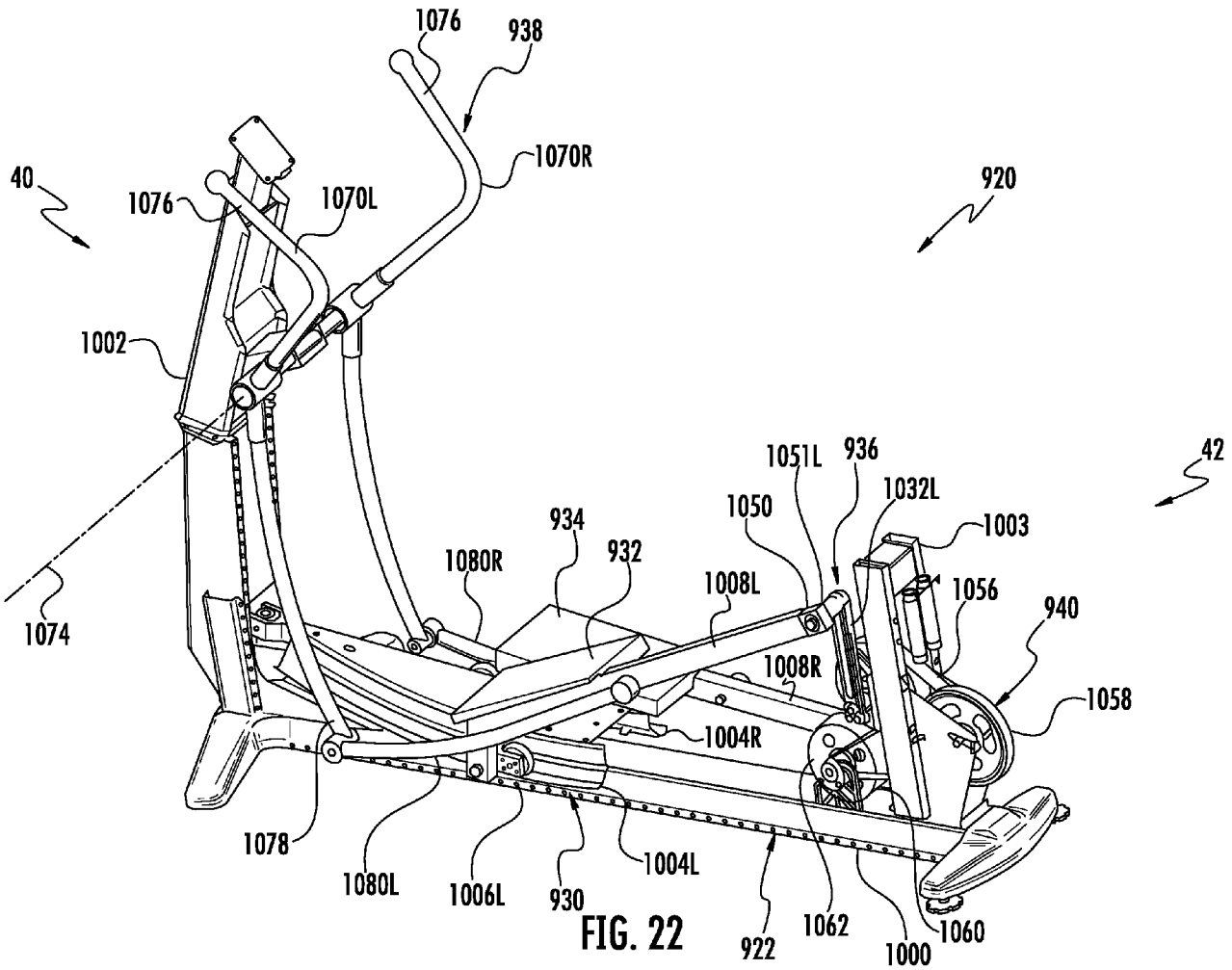
FIG. 22 is a left perspective view of another example exercise apparatus.
Figure 23:
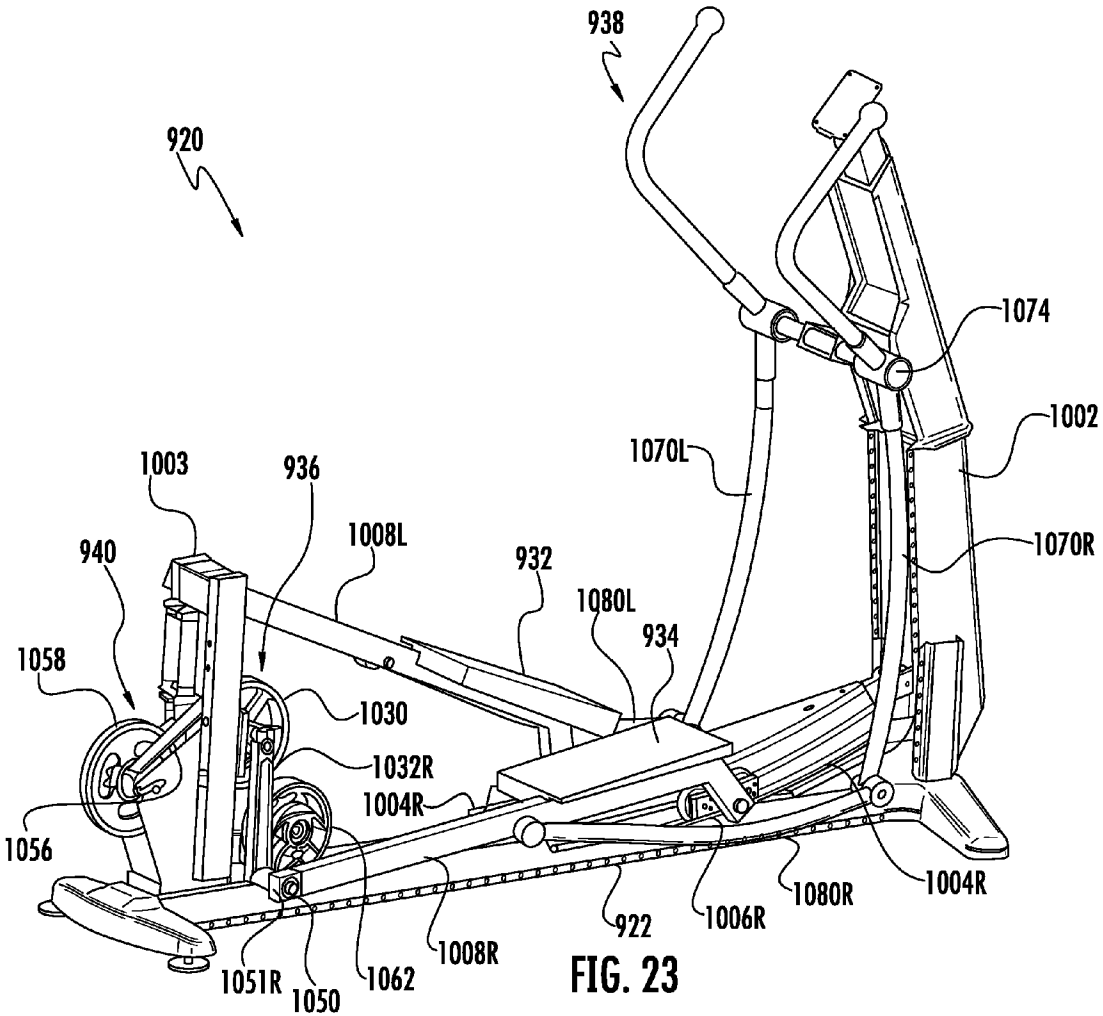
FIG. 23 is a right perspective view of the exercise apparatus of FIG. 22.

FIG. 19 illustrates two extreme positions of tracks 646 during different stages of a stride of a person exercising with footpad 32, 34 at different locations. FIG. 19 illustrates track 646 in broken lines when footpads 32, 34 are forwardly and rearwardly offset from one another such as in the state shown in FIG. 14 when footpad 34 is proximate to front end 40 while footpad 32 is proximate to rear 42. FIG. 19 shows the tracks positioned as if footpad 32 is toward front end 34 is toward rear, opposite of FIG. 14. As shown by such broken lines, exercise apparatus 820 performs similar to exercise apparatus 620. The forward positioning of footpad 34 results in a greater load being placed upon track 646R proximate to front end 40 as compared to the load placed upon track 646L proximate to front end 40. Because the load seeks the low point on the incline angled axis 876, track 646R pivots inward about axis 777R, towards the centerline of exercise apparatus 620. As shown by solid lines, when footpad 32 is forward relative to footpad 34, the forward positioning of footpad 32 results in a greater load being placed upon track 646L proximate to front end 40 as compared to the load placed upon track 646R proximate to front end 40. Because the load seeks the low point on the incline angled axis, track 646L pivots inward, towards the centerline of exercise apparatus 620 about axis 876. As a result, track 646 utilizes gravity to automatically pivot in response to the position of foot pads 32, 34 and the load being placed upon track 646 such that footpads 32, 34 are closer to the longitudinal centerline of exercise apparatus 720 when proximate to front end 40 as compared to when footpads 32, 34 are passing one another, providing the person exercising with the more natural and ergonomic foot plant locations.

Figure 21:
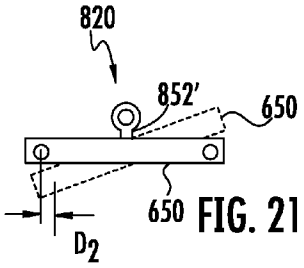
FIG. 21 is an end view of a portion of another exercise apparatus illustrating to alternative positions for another pendulum of a second length supporting tracks.

FIGS. 20 and 21 illustrate how the length of pendulum 852 impacts and extent to which footpads 32, 30 far closer to the longitudinal centerline of exercise apparatus to relate 20 when proximate front end 40 as compared to when footpad 32, 34 are passing one another. FIG. 20 is a rear end view of pendulum 852 of FIG. 18 in a centered position and one extreme position. FIG. 20 illustrates pendulum 852 and front cross connector 650 in solid lines at a point in time when footpads 32, 34 are side-by-side. FIG. 20 illustrates pendulum 852 and front cross connector 650 in broken lines when footpad 32 is proximate to front end 40 while footpad 34 is proximate to rear end 42. As shown by such broken lines, the load placed upon footpad 32 proximate front end 40 pivots pendulum 852 in a counterclockwise direction (as seen in FIG. 20) to move footpad 32 (supported by track 646L on the left side of cross support 650) inward towards the longitudinal centerline of exercise apparatus 820 by a distance D1.

FIG. 21 illustrates shorter pendulum 852 and cross connector 648. FIG. 21 illustrates exercise apparatus 820' in the same state as shown in FIG. 20, with footpad 32 and 34 in the same location along track 646 and with the same amount of load being placed upon footpad 32 and 34. As shown by broken lines in FIG. 21, the load placed upon footpad 32 proximate front end 40 pivots pendulum 852' in a counterclockwise direction (as seen in FIG. 21) to move footpad 32 (supported by track 646L on the left side of cross support 650) inward towards the longitudinal centerline of exercise apparatus 820 by a distance D2. Distance D2 is shorter than Distance D1 shown in FIG. 20. The shorter distance D2 is attributable to the shorter length of pendulum 852'.

FIGS. 22-29 illustrate exercise apparatus 920, an example implementation of exercise apparatus 20. Exercise apparatus 920 is similar to exercise apparatus 320 in that exercise apparatus 920 utilizes stationary or fixed converging tracks or ramps that guide movement of footpads such that when a footpad is proximate to front end of the exercise apparatus, the footpad is transversely closer to longitudinal centerline of the exercise apparatus as compared to when the footpad is passing the other footpad. As a result, such footpads move along paths that are more natural and ergonomic.

Figure 24:
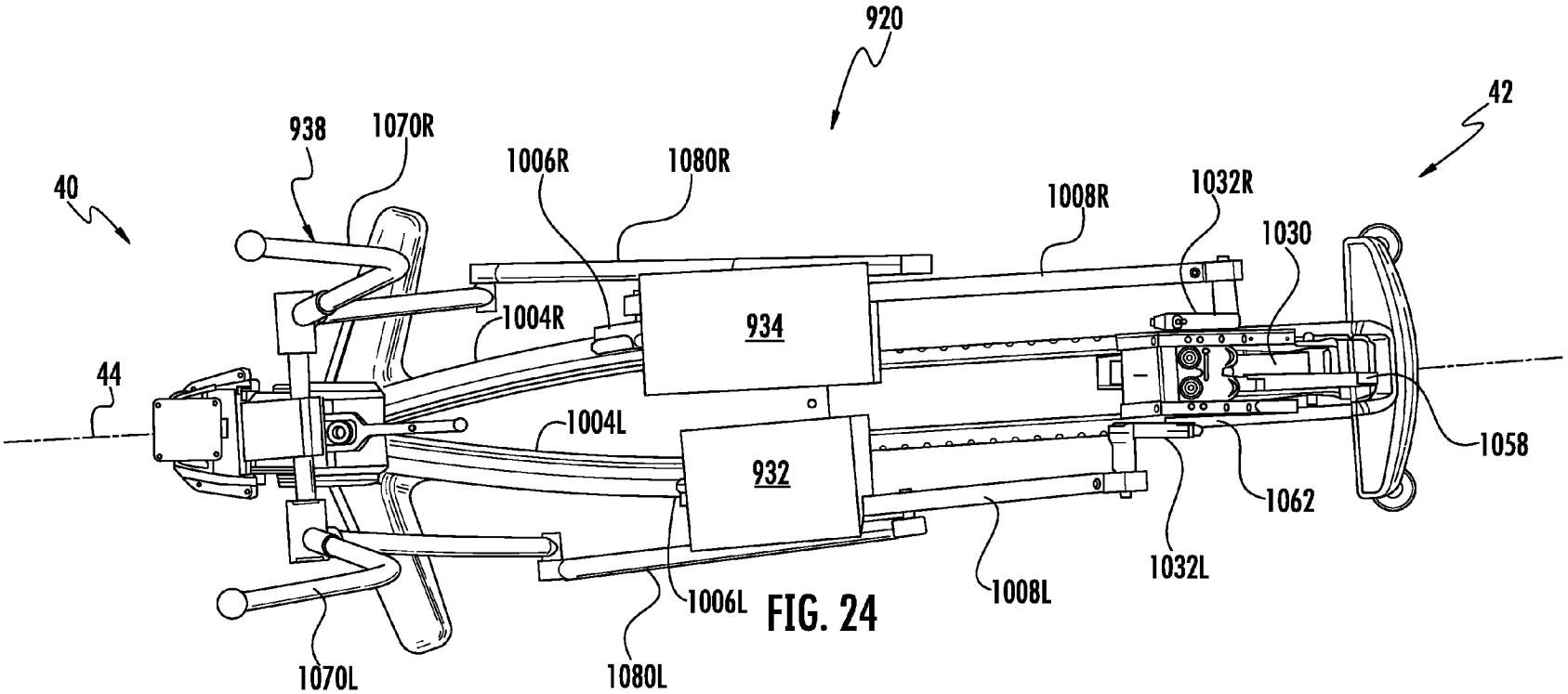
FIG. 24 is a top view of the exercise apparatus of FIG. 22.

As shown by FIGS. 22-25, exercise apparatus 920 comprises frame 922, motion guide 930, foot pads 932, 934, crank assembly 936, swing arm assembly 938 and resistance source 940. Frame 922 comprises a base, foundation, frame or other structure serving as a platform for the remaining components of exercise apparatus 20. In the example illustrated, frame 922 comprises a base portion 1000 and an upwardly extending post 1002 at front end 40. Base portion 1000 extends from front end portion 1002 toward the rear end 42 of exercise apparatus 920. Exercise apparatus 20 is configured such that a person utilizing exercise apparatus 920 faces front end 40 while exercising. As shown by FIG. 24, exercise apparatus 920 comprises a fore-aft extending longitudinal centerline 44 which bisects exercise apparatus 920 into a left side and a right side.

Motion guide 930 comprises one or more structures which guide reciprocating and alternating movement of footpads 932, 934 during striding by the person exercising. Left foot pad 932 comprises a platform, pedal or foot rest upon which a person exercising places his or her left foot while striding. Left foot pad 932 is located on the left side of centerline 44. Right foot pad 934 comprise a platform, pedal or foot rest upon which a person exercising places his or her right foot while striding.

Motion guide 930 guides the movement of footpads 932, 934 such that when footpads 932 is moving towards front end 40, footpads 934 is moving towards rear end 42, and vice versa. Motion guide 930 further guides movement of footpad 932 such that when footpads 932 is proximate to front end 40, footpad 932 is transversely spaced from longitudinal centerline 44 by a first transverse distance and when footpad 932 is passing footpad 934, foot pad 932 is transversely spaced from longitudinal centerline 44 by a second transverse distance which is greater than the first transverse distance. Likewise, motion guide 30 further guides movement of footpad 934 such that when footpads 934 is proximate to front end 40, footpad 934 is transversely spaced from longitudinal centerline 44 by the first transverse distance and when footpad 934 is passing footpad 932, foot pad 934 is transversely spaced from longitudinal centerline 44 by the second transverse distance. As a result, motion guide 930 guides movement of footpads 932, 934 along paths that are more natural and ergonomic.

Figure 25:
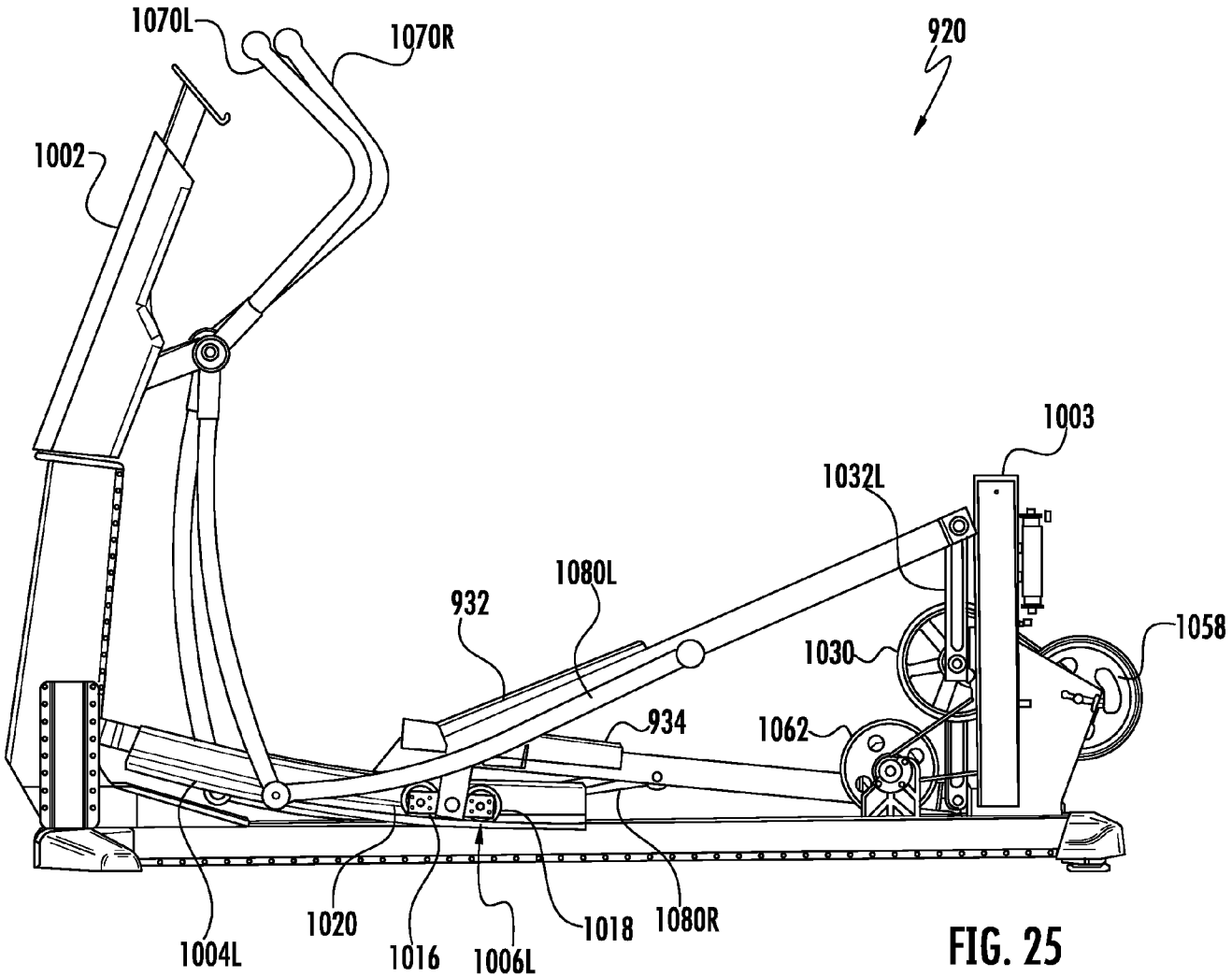
FIG. 25 is a left side view of the exercise apparatus of FIG. 22.

In the example illustrated, motion guide 930 comprises tracks 1004L, 1004R (collectively referred to as tracks 1004), trolleys 1006L, 1006R (collectively referred to as trolleys 1006), and foot links 1008L, 1008R (collectively referred to as foot links 1008). Tracks 1004 extend on opposite side of centerline 44 and guide movement of trolleys 1006 in the fore and aft directions. In the example illustrated, tracks 1004 are curved in both a vertical dimension as seen in FIG. 25 so as to provide an incline in a horizontal dimension and in a vertical dimension as seen in FIG. 24 so as to converge towards one another to position footpads 932, 934 closer to centerline 44 proximate front 44 as compared to when footpads 932, 934 are proximate to rear 42.

Figure 26:
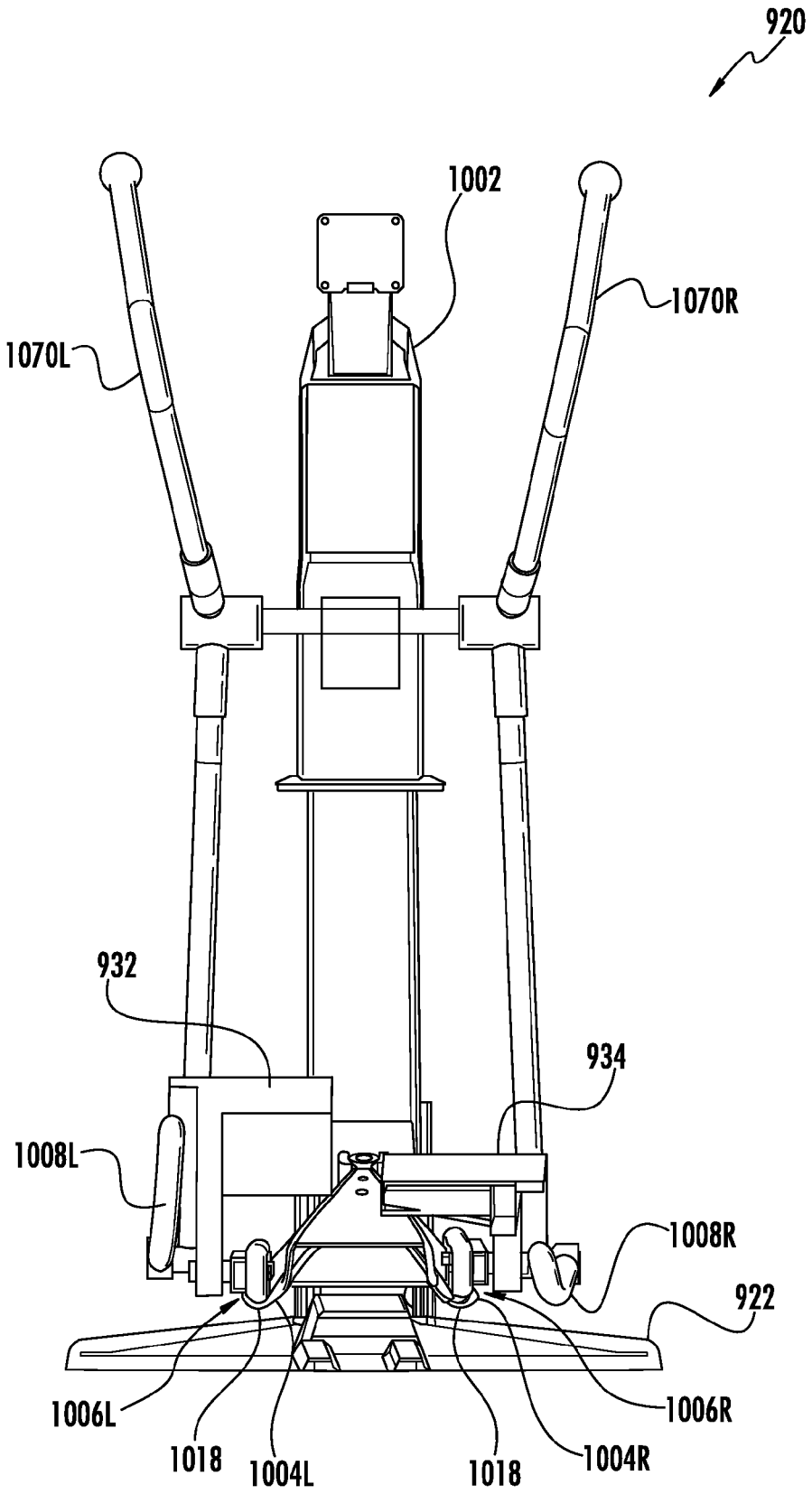
FIG. 26 is a sectional view of the exercise apparatus of FIG. 22.
Figure 27:
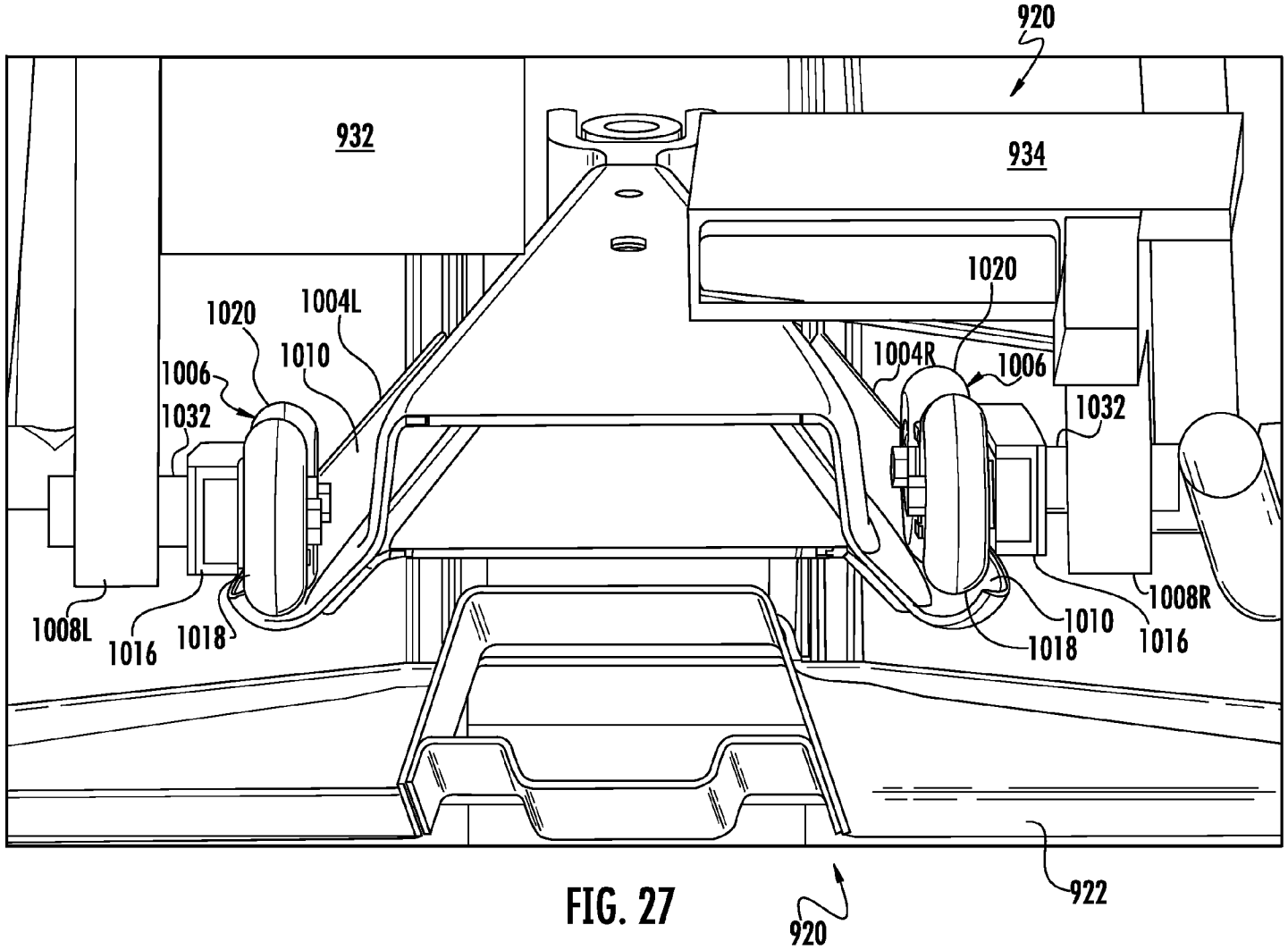
FIG. 27 is an enlarged fragmentary sectional view of a portion of the exercise apparatus of FIG. 22.

FIGS. 26 and 27 are sectional views of exercise apparatus 920 illustrating tracks 1004 in more detail. As shown by FIGS. 26 and 27, tracks 1004 each comprise J-shaped structures having an outer groove or channel 1010 in which trolleys 106 roll or ride. In other implementations, tracks 1004 may have other configurations. For example, in other implementations, tracks 1004 may alternatively comprise cylindrical rods which have in the same compound curve as the illustrated tracks 1004, wherein trolleys 1006 comprise circumferential grooves or channels that ride upon the circumferential surfaces of such rods.

Figure 28:
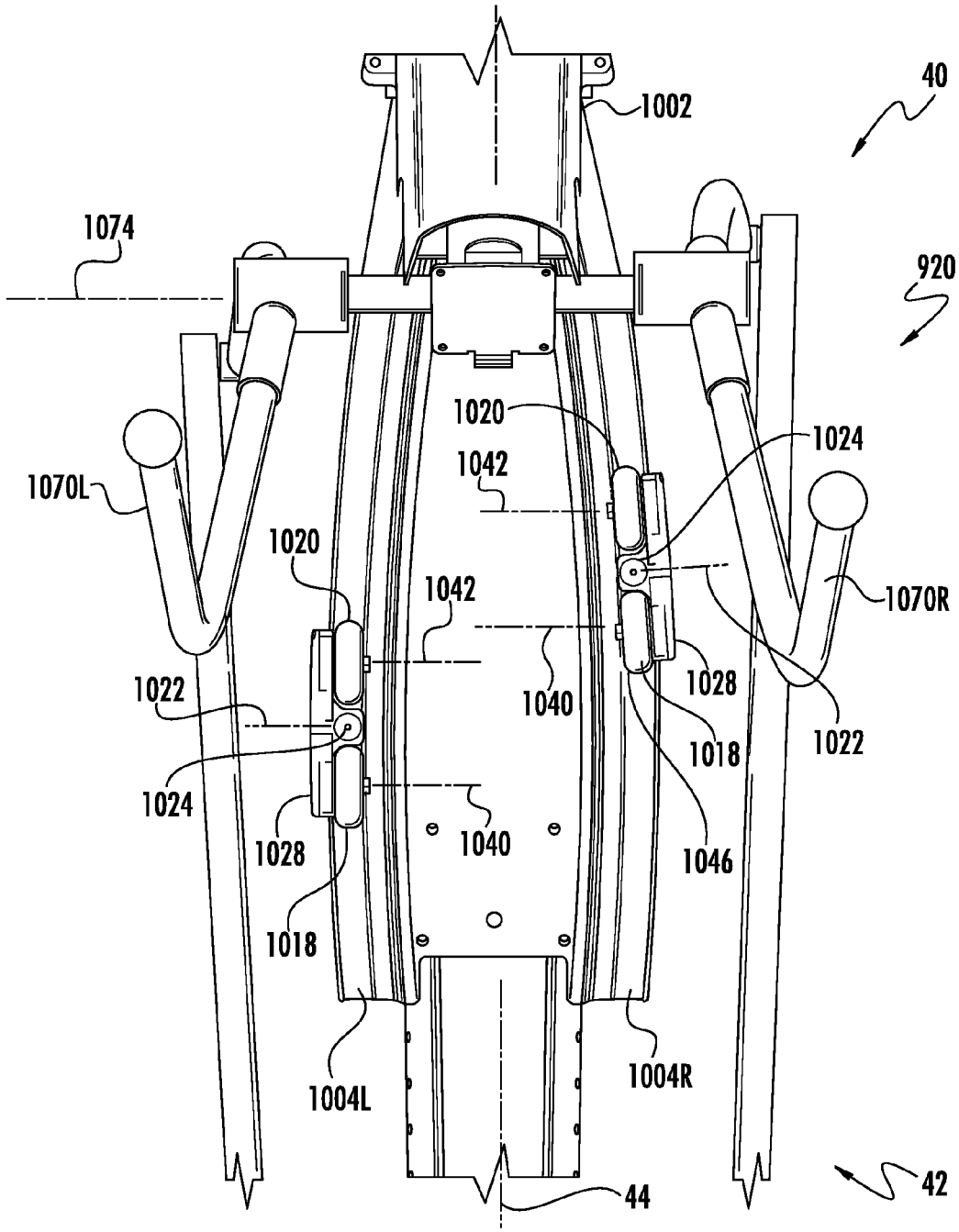
FIG. 28 is a fragmentary top view of the exercise apparatus of FIG. 22 with portions omitted for purposes of illustration.
Figure 29:
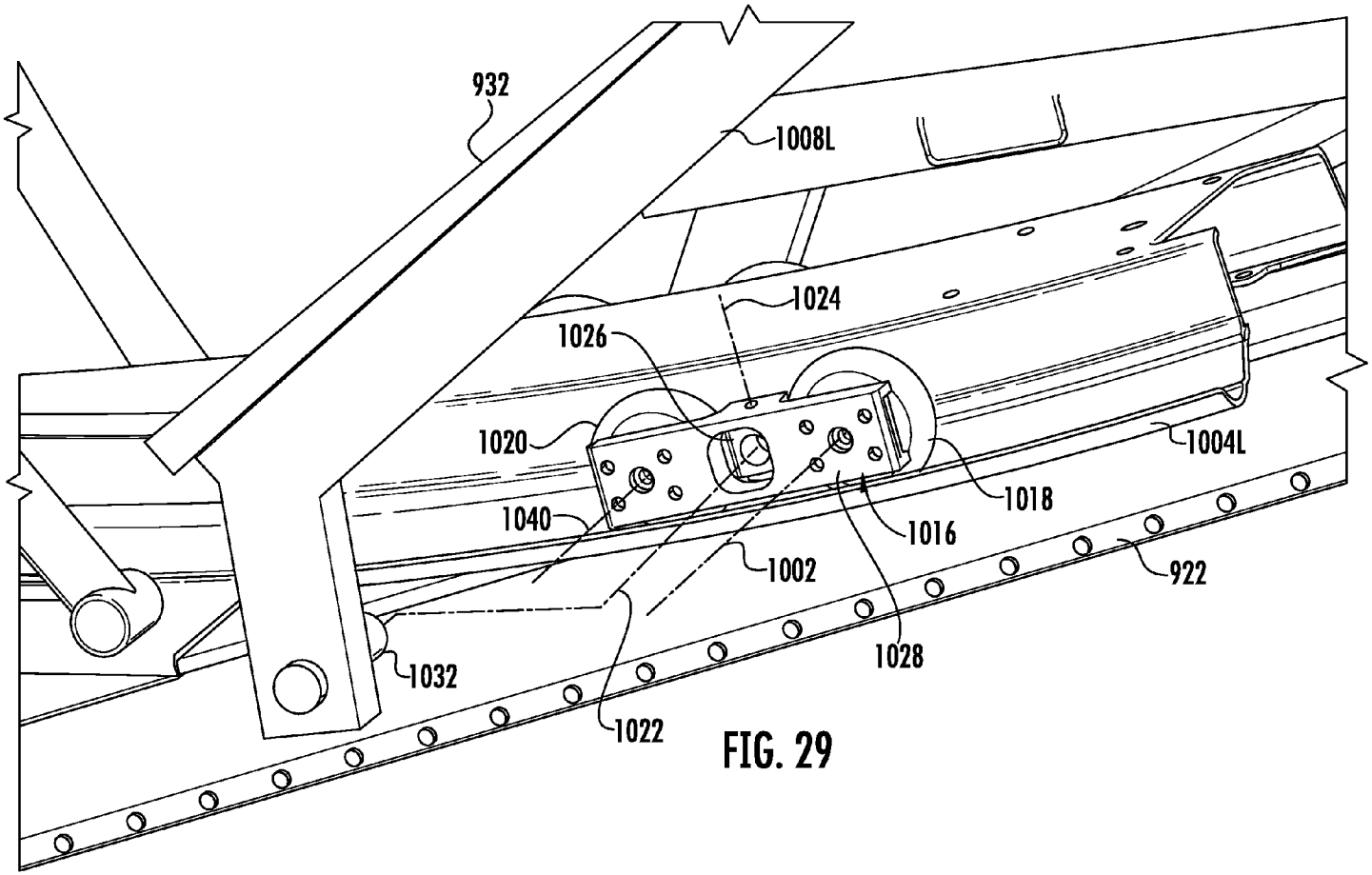
FIG. 29 is an enlarged fragmentary perspective view of a left side of the exercise apparatus of FIG. 22 illustrating a foot link exploded away from a trolley.

Trolleys 1006 are similar to trolleys 402 and 502 described above. FIGS. 28 and 29 illustrate trolleys 1006 in more detail. FIG. 28 is a top view of exercise apparatus 920 with foot links 1008 and a portion of swing arm assemblies 938 removed. FIG. 29 is an enlarged fragmentary view of trolley 1006L with foot link 1008 exploded away from trolley 1006L for purposes of illustration. Each of trolleys 1006 comprises bracket 1016 and wheels or rollers 1018, 1020. Bracket 1016 movably supports rollers 1018 and 1020 relative to foot links 1008. Bracket 1016 facilitates pivotal movement of rollers 1018, 1020 about axis 1022 and 1024. In the example shown, bracket 1016 comprises foot link mounting joint 1026 (shown in FIG. 29) and roller support 1028. Foot link mounting joint 1026 comprises a member located between rollers 1018, 1020. Joint 1026 comprises bore 1030 which pivotably or rotationally receives shaft 1032 projecting from the associate of foot link 1008L, 1008R. Bore 1030 cooperates with shaft 1032 to pivotably or rotationally support the associated trolley 1006 for rotation about axis 1022 (shown in FIG. 28). As a result, each of trolleys 1006 pivots to accommodate the curvature of tracks 1004 in the vertical dimension (the upwardly inclined curvature of tracks 1004 as tracks 1004 approach front end 44). In other implementations, other structures may be provided that facilitate pivotal movement of trolleys 1004 about axes 1022.

Roller support 1028 comprises a structure which rotatably supports each of rollers 1018 and 1020. Roller support 1028 is pivotably coupled to joint 1026 for pivotal movement about axis 1024. In one implementation, roller support 1028 is pinned to joint 1026 to facilitate relative pivotal movement between the support 1028 and joint 1026 about axis 1024 which is substantially perpendicular axis 1022. As a result, roller support 1028 and rollers 1018, 1020 may pivot about axis 1024 to accommodate the curvature of tracks 1004 in the horizontal dimension. Although each roller support 1028 is illustrated as extending an outer side of rollers 1018, 1020, in other implementations, roller support 1028 may alternatively extend on an inner side of rollers 1018, 1020 or over and above each of rollers 1018, 1020 in a fashion similar to illustrated above with respect to trolley 502.

Rollers 1018, 1020 are each rotationally supported by wheel support 1028. As shown by FIG. 28, roller 1018 is rotationally supported about axis 1040. Roller 1020 is rotationally supported about axis 1042. Axes 1040 and 1042 extend oblique relative to one another such that axes 1040 and 1042 ultimately converge or cross one another in space on a side of rollers 1018, 1020 proximate to longitudinal centerline 44. In one implementation, rollers 1018, 1020 rotate about oblique, non-parallel axes such that rollers 1018, 1020 are centered and located along an arc corresponding to the curvature of tracks 1004 in the horizontal dimension. As a result, rollers 1018, 1020 better track along the curvature of tracks 1004. In one implementation, each of axes 1040, 1042 converge towards one another on the side of the longitudinal centerline 44 at an angle of between 1 degree and 5 degrees offset from axis 1022 and nominally at an angle of 2°.

In the example illustrated, axes 1040 and 1042 are each further inclined from horizontal such that the top side of each of rollers 1018, 1020 leans inward towards longitudinal centerline 44. As a result, tracking of rollers 1018, 1020 along the curvature of tracks 1004 is enhanced. In other implementations, the angular offset between the axes 1040, 1042 of rollers 1018, 1020 and/or the inclination of the axes 1040, 1042 about which rollers 1018, 1020 rotate may be omitted. Although rollers 1018, 1020 are illustrated as comprising convex rolling surfaces 1046 rollable within tracks 1004, in other implementations in which tracks 1004 comprise rods, rollers 1018, 1020 alternatively have concave outer surfaces that ride upon such rods.

Foot links 1008 support footpads 932, 934. As noted above, foot links 1008 each comprise a shaft 1032 (shown in FIG. 29) rotationally or pivotally received within bore 1030 of joint 1026. Each of foot links 1008 additionally has a second end 1050 pivotally connected to crank arm assembly 936.

Crank arm assembly 936 comprises crank input pulley 1030 and crank arms 1032L, 1032R (collectively referred to as crank arms 1032). Flywheel 1030 is rotatably supported by rear post 1003 about a substantially horizontal axis. Crank arm 1032L is fixed to and extends from crank input pulley 1030 and is pivotally connected to a rear end portion 1050 of foot link 1008L. In the example illustrated, crank arm 1032L is pivotally connected to rear end portion 1050 of foot link 1008L by pivot block 1051L which facilitates relative pivotal movement of end portion 1050 and crank arm 1032R about both vertical and horizontal axes. The vertical axis pivot is facilitates angling of the foot link 1008L inwardly and outwardly through the stride as it travels along the inwardly angled ramp. Crank arm 1032R is fixed to and extends from crank input pulley 1030 and is pivotally connected to a rear end portion 1050 of foot link 1008R. As with crank arm 1032 L, crank arm 1032R is pivotally connected to rear end portion 1050 of foot link 1008R by pivot block 1051R which facilitates relative pivotal movement of end portion 1050 and crank arm 1032R about both vertical and horizontal axes. The vertical axis facilitates angling of the foot link 1008R inwardly and outwardly through the stride as it travels along the inwardly angled ramp. Crank arms 1032 link motion of footpads 932 and 934 such that the reciprocal movement of footpads 932 and 934 is approximately 180° out of phase. Crank assembly 936 further applies a first extent of resistance against motion of footpads 932, 934.

Resistance source 940 comprises a supplemental source of resistance to resist reciprocating movement of footpads 932 and 934. In the example illustrated, resistance source 940 is operably coupled to footpads 932, 934 via crank assembly 936. Resistance source 940 comprises transmission belt 1056, step up pulley 1058, transmission belt 1060 and flywheel/eddy brake 1062. Transmission belt 1056 transmits torque from crank input pulley 1030 to step up pulley 1058. Step up pulley 1058 comprises a compound pulley having a smaller sheave or pulley about which transmission belt 1056 wraps in a larger pulley about which transmission belt 1060 wraps. Transmission belt 1060 transmits torque from fly step a pulley 1058 to flywheel/eddy brake 1062. In the example illustrated, resistance source 940 is illustrated as employing a belt and pulley arrangement for transmitting torque from crank arm assembly 936 to flywheel/eddy brake 1062. In other implementations, resistance source 936 alternatively comprises a chain and sprocket arrangement or gear trains to transmit torque from crank assembly 936 to flywheel/eddy brake 1062.

Eddy brake 1062 comprises a metal eddy current member formed from aluminum or other metal position opposite to a magnet, wherein at least one of the eddy current member and the magnet are rotated relative to one another utilizing torque received from transmission belt 1060. In one implementation, the power of the magnet or the proximity of the magnet and the eddy current member are adjustable to adjust a degree of resistance applied by resistance source 940 to the fore and aft movement of footpads 932, 934 along tracks 1004. In one implementation, exercise apparatus 920 comprises a powered actuator to make such adjustments in response to control signals received via a control panel or other control device of exercise apparatus 920. In still other implementations, resistance source 940 may have other configurations or may be omitted.

In one implementation, resistance source 940 comprises a friction resistance source in which rotation of two members relative to another is frictionally resisted. In yet another implementation, resistance source 940 comprises an eddy current brake. In one implementation, supplemental resistance provided by resistance source 162 against reciprocating movement of footpads 32, 34 is adjustable by an operator. In some implementations, resistance source 940 may be omitted.

Swing arm assembly 938 comprises swing arms 1070L, 1070R (collectively referred to as swing arms 1070) which are rotatably supported by post 1002 for pivotal movement about axis 1074. Each of swing arms 1070 has an upper end 1076 serving as a grip and a lower portion 1078 pivotally connected to swing arm link 1080. Swing arm link 1080 extends from the associated swing arm 1070 and is pivotally connected to associate of foot link 1008. In particular, swing arm 1070L is pivotally connected to link 1080L which is pivotally connected to foot link 1008L. Likewise, swing arm 1070R is pivotally connected to link 1080R which is pivotally connected to foot link 1008R. Swing arms 1070 reciprocate forwardly and rearwardly about axis 1074 as footpads 932, 934 and their associated foot links 1008 reciprocate back and forth, providing exercise to the upper body of a person using exercise apparatus 920. In one implementation, a resistance is applied to the swinging motion of swing arms 1070. In other implementations, swing arms 1070 may be omitted, such as in implementations where exercise apparatus 920 alternatively comprises stationary arms or bars.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An exercise apparatus comprising:

a frame;

a left inclined track;

a left foot pad movably guided along the left inclined track;

a right inclined track, the left inclined track and the right inclined track extending on opposite sides of a fore-aft longitudinal centerline symmetrically extending between the left inclined track and the right inclined track, each of the left inclined track and the right inclined track being coupled to the frame so as to be fixed relative to the longitudinal centerline, each of the left inclined track and the right inclined track comprising a curved portion with a concave side of the curved portion facing the longitudinal center line;

a right foot pad movably guided along the right inclined track, wherein the right inclined track has a right front portion transversely spaced from the fore-aft longitudinal centerline by a right front spacing distance and a right rear portion transversely spaced from the fore-aft longitudinal centerline by a right rear spacing distance greater than the right front spacing distance; and a crank arm assembly operably coupled to the left foot pad and the right foot pad.

2. The exercise apparatus of claim 1, wherein the left inclined track has a left front portion spaced from the fore-aft longitudinal centerline by a left front spacing distance and a left rear portion spaced from the fore-aft longitudinal centerline by a left rear spacing distance greater than the left front spacing distance.

3. The exercise apparatus of claim 2, wherein the left inclined track converges towards the right inclined track as the left inclined track upwardly extends towards a front of the exercise apparatus.

4. The exercise apparatus of claim 2, wherein the left inclined track and the right inclined track are each curved in a first dimension.

5. The exercise apparatus of claim 4, wherein the left inclined track and the right inclined track are each curved in a second dimension.

6. The exercise apparatus of claim 4 further comprising:

a first roller carried by the right foot pad rotatable about a first axis to support the right foot pad on the right inclined track; and a second roller carried by the right foot pad and rotatable about a second axis to support the right foot pad on the right inclined track, wherein the first axis and the second axis are oblique to one another.

7. The exercise apparatus of claim 6, wherein the first axis is inclined relative to horizontal such that the first roller leans towards the fore-aft longitudinal centerline of the exercise apparatus.

8. The exercise apparatus of claim 2 further comprising a roller carried by the right foot pad and movably supporting the right foot pad along the right inclined track.

9. An exercise apparatus comprising:

a left inclined track on a first side of a longitudinal centerline of the exercise apparatus and curving towards the longitudinal centerline as the left inclined track extends towards a front of the exercise apparatus;

a left foot pad movably guided along the left inclined track;

a right inclined track on a second side of the longitudinal centerline and curving towards the longitudinal centerline as the right inclined track extends towards the front of the exercise apparatus;

a right foot pad movably guided along the right inclined track; and a crank assembly operably coupled to the left foot pad and the right foot pad.

10. The exercise apparatus of claim 9, wherein the left inclined track and the right inclined track curve upwardly as the left inclined track and the right inclined track extend towards the front of the exercise apparatus.

11. The exercise apparatus of claim 9 further comprising:

a first roller carried by the right foot pad rotatable about a first axis to support the right foot pad on the right inclined track; and a second roller carried by the right foot pad and rotatable about a second axis to support the right foot pad on the right inclined track, wherein the first axis and the second axis are oblique to one another.

12. The exercise apparatus of claim 11, wherein the first axis is inclined relative to horizontal such that the first roller leans towards the longitudinal centerline of the exercise apparatus.

13. A method comprising:

guiding inclined movement of a left foot pad in a fore-aft direction on a first side of a longitudinal centerline of an exercise apparatus along a curved path having a concave side facing the longitudinal centerline with a crank arm assembly operably coupled to the left foot pad; and guiding inclined movement of a right foot pad in the fore-aft direction on a second side of the longitudinal centerline of the exercise apparatus along a curved path having a concave side facing the longitudinal centerline with the crank arm assembly operably coupled to the right foot pad, wherein movement of the left foot pad and movement of the right foot pad is guided such that the right foot pad and the left foot pad are transversely spaced from the longitudinal centerline by a first distance when proximate to a front of the exercise apparatus and are transversely spaced from the longitudinal centerline by a second distance greater than the first distance when proximate to a rear of the exercise apparatus.

14. The method of claim 13, wherein the left foot pad and the right foot pad are guided along a curved path of motion curving towards the longitudinal centerline as the left foot pad and the right foot pad move towards the front of the exercise apparatus.

15. The method of claim 14, wherein the curved path of motion curves upwardly towards the front of the exercise apparatus.

16. The method of claim 13, wherein the left foot pad and the right foot pad are guided along a curved path of motion curving upwardly as the left foot pad and the right foot pad move towards the front of the exercise apparatus.

* * * * *